US010641143B2

(12) United States Patent
Miyajima et al.

(10) Patent No.: US 10,641,143 B2
(45) Date of Patent: May 5, 2020

(54) RELIEF DEVICE OF OIL CIRCUIT OF ENGINE

(71) Applicant: YAMADA MANUFACTURING CO., LTD., Kiryu-shi (JP)

(72) Inventors: Junichi Miyajima, Kiryu (JP); Takatoshi Watanabe, Kiryu (JP); Yuya Kato, Kiryu (JP)

(73) Assignee: YAMADA MANUFACTURING CO., LTD., Kiryu-Shi, Gunma (JP)

( * ) Notice: Subject to any disclaimer, the term of this patent is extended or adjusted under 35 U.S.C. 154(b) by 469 days.

(21) Appl. No.: 15/316,116

(22) PCT Filed: Jun. 23, 2015

(86) PCT No.: PCT/JP2015/067991
§ 371 (c)(1),
(2) Date: Dec. 2, 2016

(87) PCT Pub. No.: WO2016/002580
PCT Pub. Date: Jan. 7, 2016

(65) Prior Publication Data

US 2017/0114682 A1 Apr. 27, 2017

(30) Foreign Application Priority Data

Jun. 30, 2014 (JP) ..... 2014-134748
Apr. 28, 2015 (JP) ..... 2015-092295

(51) Int. Cl.
*F01M 1/16* (2006.01)
*F01M 1/02* (2006.01)
(Continued)

(52) U.S. Cl.
CPC ..... *F01M 1/16* (2013.01); *F01M 1/02* (2013.01); *F04C 2/102* (2013.01); *F04C 14/26* (2013.01);
(Continued)

(58) Field of Classification Search
CPC ..... F04C 2/102; F04C 14/26; F04C 2240/81; F04C 2270/18; F04C 2270/19;
(Continued)

(56) References Cited

U.S. PATENT DOCUMENTS 3,465,847 A 9/1969 Donath et al.
5,018,665 A 5/1991 Sulmone
(Continued)

FOREIGN PATENT DOCUMENTS

JP S55-180007 U1 12/1980
JP S 56-143509 U 10/1981
(Continued)

OTHER PUBLICATIONS

Japanese Office Action, dated Oct. 5, 2018, in Japanese Application No. 2015-121532 and English Translation thereof.
(Continued)

*Primary Examiner* — Dominick L Plakkoottam
*Assistant Examiner* — Connor J Tremarche
(74) *Attorney, Agent, or Firm* — McGinn I.P. Law Group, PLLC.

(57) ABSTRACT

[Problem] To provide a relief device for an oil circuit of an engine provided with an oil pressure relief valve and a temperature-sensitive relief valve, with which it is possible for oil to be relieved (expelled) at the intended pressure regardless of the oil temperature, and with which it is possible to simplify the configuration. [Solution] The relief device comprises an oil pump (9), an upstream channel (61) provided from a discharge side of the oil pump (9) to an engine (E), an oil pressure relief valve (A) for relieving oil due to the valve body being moved by oil pressure, and a temperature-sensitive relief valve (B) for relieving oil by sensing the oil temperature and continuously opening and closing. The oil pressure relief valve (A) and the tempera-
(Continued)

ture-sensitive relief valve (B) are arranged in parallel in the upstream channel (61).

21 Claims, 16 Drawing Sheets

(51) Int. Cl.
*F04C 14/26* (2006.01)
*F04C 2/10* (2006.01)

(52) U.S. Cl.
CPC .. *F01M 2001/0238* (2013.01); *F04C 2240/81* (2013.01); *F04C 2270/18* (2013.01); *F04C 2270/19* (2013.01); *F04C 2270/86* (2013.01)

(58) Field of Classification Search
CPC ..... F04C 2270/86; F01M 1/16; F01M 1/02; F01M 2001/0238
USPC ..... 417/308
See application file for complete search history.

(56) References Cited

U.S. PATENT DOCUMENTS

| | | | | |
|---|---|---|---|---|
| 5,033,865 | A * | 7/1991 | Kuze | G05D 23/021 236/101 C |
| 5,084,964 | A | 2/1992 | Cyphers | |
| 5,547,349 | A | 8/1996 | Kimura et al. | |
| 6,457,652 | B1 | 10/2002 | Fukamachi | |
| 6,736,091 | B1 | 5/2004 | Tibbles | |
| 7,588,011 | B2 * | 9/2009 | Ono | F04C 2/102 123/196 R |
| 7,819,093 | B2 * | 10/2010 | Yamashita | F01M 1/16 123/196 R |
| 9,772,632 | B1 * | 9/2017 | Ihns | G05D 23/1333 |
| 2004/0169090 | A1 * | 9/2004 | Kawasaki | F01P 5/10 236/101 R |
| 2004/0226613 | A1 * | 11/2004 | Ono | F01M 1/16 137/468 |
| 2006/0171818 | A1 | 8/2006 | Kato | |
| 2010/0326375 | A1 * | 12/2010 | Furukoshi | F01P 7/16 123/41.09 |
| 2015/0377097 | A1 | 12/2015 | Miyajima et al. | |
| 2015/0377234 | A1 | 12/2015 | Miyajima et al. | |
| 2017/0114682 | A1 | 4/2017 | Miyajima et al. | |

FOREIGN PATENT DOCUMENTS

| | | | |
|---|---|---|---|
| JP | S 58-057553 | A | 4/1983 |
| JP | 2-34404 | Y2 * | 9/1990 |
| JP | H 06-123211 | A | 5/1994 |
| JP | 2006-214286 | A | 8/2006 |
| JP | 2009-138537 | A | 6/2009 |
| JP | 2011-038403 | A | 2/2011 |

OTHER PUBLICATIONS

United States Office Action dated May 11, 2018 in co-pending U.S. Appl. No. 14/750,910.
United States Office Action dated Sep. 20, 2017 in co-pending U.S. Appl. No. 14/750,910.
International Search Report (ISR) (PCT Form PCT/ISA/210), in PCT/JP2015/067991, dated Oct. 6, 2015.
United States Office Action dated Dec. 21, 2017 in co-pending U.S. Appl. No. 14/750,910.
Japanese Office Action, dated Aug. 28, 2018, in Japanese Application No. 2015-121506, and English translation thereof.
United States Office Action dated May 25, 2017 in co-pending U.S. Appl. No. 14/750,910.
Japanese Office Action, dated Apr. 16, 2019, in Japanese Applicaiton No. 2015-121506 and English Translation thereof.
United States Office Action dated Jun. 29, 2017 in co-pending U.S. Appl. No. 14/750,985.

* cited by examiner

Fig. 10A
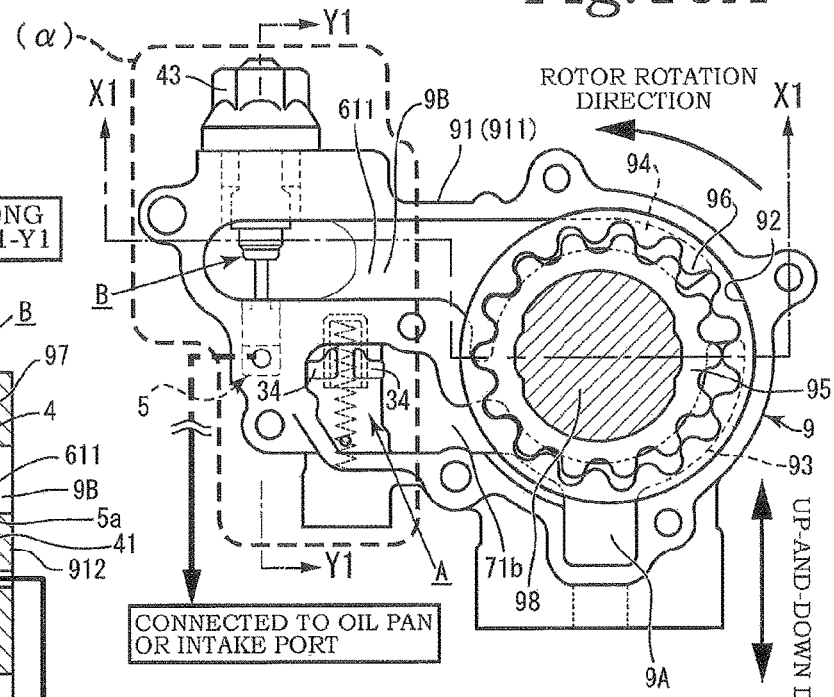
Fig. 10B
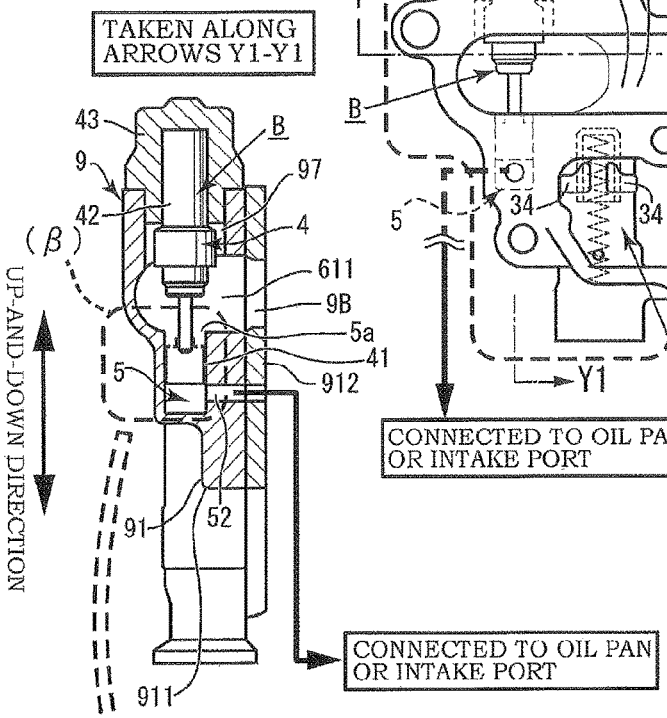
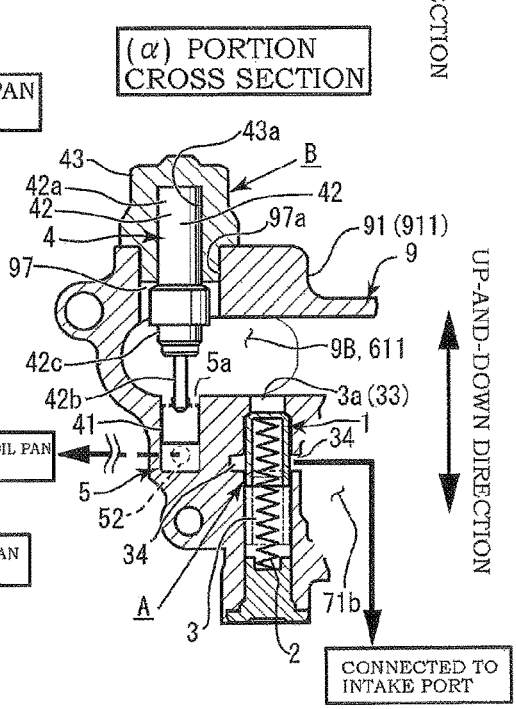
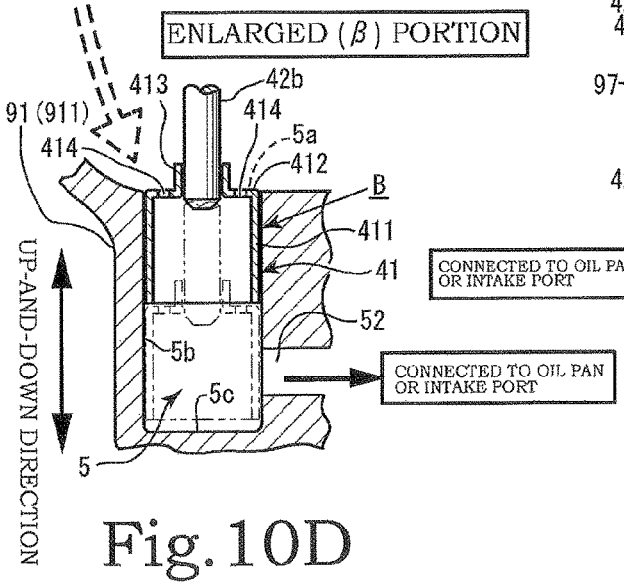
Fig. 10D
Fig. 10C

OIL RELIEF IS PERFORMED (LARGE AMOUNT)

OIL RELIEF IS PERFORMED (SMALL AMOUNT)

OIL RELIEF IS NOT PERFORMED

H
5a
52
5b
5c
5
4
42b
d
h
413
414
412
41
411
D1
D2
D3

RELIEF DEVICE OF OIL CIRCUIT OF ENGINE

TECHNICAL FIELD

The present invention relates to a relief device of an oil circuit of an engine that includes an oil pressure relief valve and a temperature-sensitive relief valve, allows execution of oil relief (discharge) at aimed pressure of oil irrespective of the level of the temperature of the oil, and allows simplification of its configuration.

BACKGROUND ART

Conventionally, there are various pumps for supplying oil for lubrication and cooling to an engine, each of which includes a relief valve that performs relief in the case where discharge pressure exceeds a predetermined value. In addition, there is also a relief device of an oil circuit of an engine of a type that determines whether or not the relief is executed in accordance with a change in pressure and a change in the temperature of oil.

A specific example of this type includes a third embodiment of PTL 1. The third embodiment of PTL 1 is an oil pump that includes a first control valve (4) and a second control valve (7). PTL 1 will be outlined. Note that reference numerals used in PTL 1 are used without any alterations. The first control valve (4) is configured to function as a relief valve in the case where the discharge pressure of hydraulic oil in a discharge oil path (5) located downstream of an oil pump X is high.

The second control valve (7) is a valve that operates in accordance with the temperature of the hydraulic oil to control the first control valve (4), specifically control the oil pressure of the hydraulic oil that flows into a second valve chamber (44) of the first control valve (4). The second control valve (7) includes a valve body operation mechanism (73) that causes a valve body (72) to reciprocate in accordance with the temperature of the hydraulic oil. The valve body operation mechanism (73) is a temperature-sensitive extendable body (73*a*) that extends and retracts and, specifically, a spring made of a shape-memory alloy is used as the temperature-sensitive extendable body (73*a*).

The first control valve (4) and the second control valve (7) are caused to communicate with each other with a first inter-valve oil path (91) and a second inter-valve oil path (92). The control of the oil pressure in a valve body (42) of the first control valve (4) is performed by switching between communication and non-communication with the first inter-valve oil path (91) and the second inter-valve oil path (92). Thus, in PTL 1, the first control valve (4) and the second control valve (7) do not operate independently of each other but operate in cooperation with each other.

CITATION LIST

Patent Literature

[PTL 1] Japanese Patent Application Laid-open No. 2006-214286

SUMMARY OF INVENTION

Technical Problem

In PTL 1, the second control valve (7) expands or retracts in accordance with a change in oil temperature, and hence the first control valve (4) operates under the influence of the oil temperature. A high oil temperature denotes about 110° C. to 130° C. and, the viscosity of the oil when the oil temperature is, e.g., 50° C. is higher than that when the oil temperature is about 110° C. to 130° C., and hence oil pressure is high.

Therefore, during a low oil temperature period in which the oil temperature is 50° C., the discharge pressure per unit rpm of a rotor is higher than that when the oil temperature is about 110 to 130° C., and hence the gradient of a straight line L1 described in each drawing becomes steep and, when the discharge pressure rises to a predetermined value, the first control valve (4) performs the relief of the discharge pressure. With the operation described above, the oil pressure is higher during the low oil temperature period, and hence a large energy loss has been caused, and an improvement in fuel efficiency during the low oil temperature period has been inhibited.

The second control valve (7) as the temperature-sensitive valve is a control valve for increasing and decreasing the relief pressure of the first control valve (4), the control variation of the second control valve (7) and the control variation of the first control valve (4) have been added up due to their serial connection, and a large control variation has been produced. In addition, the second control valve (7) is a valve for controlling the oil pressure instead of the flow rate, and hence the second control valve (7) is a so-called ON/OFF valve with which almost entire oil pressure propagates when there is any opening, and it has been difficult to perform fine control.

To cope with this, an object (Technical Problem) of the present invention is to provide a relief device of an oil circuit of an engine that is capable of obtaining substantially the same oil pressure characteristic irrespective of the level of the oil temperature, is capable of preventing a reduction in fuel efficiency especially during the low oil temperature period, is inexpensive, and has high reliability with an extremely simple configuration.

Solution to Problem

As the result of elaborate studies by the inventors conducted in order to solve the above problem, a first aspect of the invention is a relief device of an oil circuit of an engine including an oil pump, an upstream flow path that is provided from a side of a discharge portion of the oil pump to an engine, an oil pressure relief valve that performs oil relief with movement of a valve body by pressure of oil, and a temperature-sensitive relief valve that performs the oil relief by sensing an oil temperature of the oil and opening and closing steplessly, wherein the oil pressure relief valve and the temperature-sensitive relief valve are disposed in parallel in the upstream flow path, whereby the above problem is solved.

A second aspect of the invention is the relief device of an oil circuit of an engine according to the first aspect wherein the temperature-sensitive relief valve performs the oil relief when the oil has a low oil temperature, whereby the above problem is solved. A third aspect of the invention is the relief device of an oil circuit of an engine according to the first aspect wherein the temperature-sensitive relief valve performs the oil relief such that an amount of the oil relief is increased in the vicinity of a low oil temperature and is reduced in the vicinity of a high oil temperature when the oil has a middle oil temperature, whereby the above problem is solved. A fourth aspect of the invention is the relief device of an oil circuit of an engine according to the first aspect wherein the temperature-sensitive relief valve does not perform the oil relief when the oil temperature has a high oil temperature, whereby the above problem is solved.

A fifth aspect of the invention is the relief device of an oil circuit of an engine according to any one of the first to fourth aspects wherein the temperature-sensitive relief valve is provided in the engine, whereby the above problem is solved. A sixth aspect of the invention is the relief device of an oil circuit of an engine according to anyone of the first to fifth aspects wherein the temperature-sensitive relief valve includes a temperature-sensitive valve body and a temperature-sensitive housing, the temperature-sensitive valve body includes a temperature-sensitive drive portion and a temperature-sensitive valve portion, the temperature-sensitive valve portion has an inflow hole, the temperature-sensitive drive portion has a piston that extends and retracts in response to an oil temperature detected with thermowax, a second relief outflow portion is formed in an inner peripheral side surface of the temperature-sensitive housing, and the temperature-sensitive valve portion is capable of opening and closing the second relief outflow portion by sliding, whereby the above problem is solved.

A seventh aspect of the invention is the relief device of an oil circuit of an engine according to the sixth aspect wherein the inflow hole of the temperature-sensitive valve portion is configured so as not to intersect an outer periphery of a top portion of the temperature-sensitive valve portion, and the inflow hole is configured so as to be smaller in opening area than the second relief outflow portion, whereby the above problem is solved. An eighth aspect of the invention is the relief device of an oil circuit of an engine according to any one of the first to seventh aspects wherein a protruding portion that concentrates a flow of the oil at a temperature-sensitive drive portion of the temperature-sensitive relief valve is formed so as to bulge at a position in the discharge portion in the vicinity of an upstream side of the temperature-sensitive relief valve, whereby the above problem is solved. A ninth aspect of the invention is the relief device of an oil circuit of an engine according to the eighth aspect wherein the protruding portion is formed into a gently inclined shape on an upstream side, whereby the above problem is solved.

Advantageous Effects of Invention

In the first aspect of the invention, by adopting the configuration in which the oil pressure relief valve that performs the relief while the valve body moves with the pressure of the oil and the temperature-sensitive relief valve that senses the oil temperature and opens and closes are disposed in parallel in the upstream flow path provided from the discharge portion of the oil pump to the engine or a main gallery of the engine, the oil pressure relief valve and the temperature-sensitive relief valve operate independently of each other.

That is, the oil pressure relief valve senses the discharge pressure of the oil pump to determine whether or not the oil relief operation is performed, and the temperature-sensitive relief valve senses the oil temperature to determine whether or not the oil relief operation is performed. Consequently, in the case where oil is sent to the engine from the oil pump via the upstream flow path, the oil pressure relief valve operates in response to a change in the discharge pressure of the oil pump that occurs from a low rpm range of the engine to a high rpm range thereof, and the temperature-sensitive relief valve operates in response to a change in the oil temperature.

The oil pressure relief valve and the temperature-sensitive relief valve are disposed in parallel in the upstream flow path, and are capable of performing the relief operation individually or simultaneously. Accordingly, when only one of the oil discharge pressure from the oil pump and the oil temperature changes and the oil relief is required, the oil pressure relief valve or the temperature-sensitive relief valve is capable of performing the oil relief in response to the requirement.

Note that, herein, "in parallel" means the disposition in which the oil pressure relief valve and the temperature-sensitive relief valve are not connected in series and, as long as they branch off from the upstream flow path and are disposed in parallel, "in parallel" includes the configuration in which one of the relief valves is disposed relatively close to the upstream side, and the other relief valve is disposed relatively close to the downstream side.

In the configuration of the present invention, the temperature-sensitive relief valve and the oil pressure relief valve are connected in parallel, and hence their respective control variations of the relief valves are not added up, and it is possible to perform more accurate control. In addition, the temperature-sensitive relief valve has a function of performing the oil relief by sensing the oil temperature and opening and closing steplessly, and hence, unlike the conventional so-called ON/OFF valve, the temperature-sensitive relief valve is capable of opening and closing steplessly. For example when the temperature-sensitive relief valve opens slightly, the temperature-sensitive relief valve performs the relief slightly, and hence the oil pressure is reduced slightly and, therefore, it is possible to perform the adjustment of the oil pressure steplessly by adjusting the opening/closing amount of the temperature-sensitive relief valve.

In the second aspect of the invention, when the oil has the low oil temperature, the oil is relieved not only from the oil pressure relief valve but also from the temperature-sensitive relief valve. With this, during the low oil temperature period when the oil pressure is high, the oil is constantly relieved from the temperature-sensitive relief valve irrespective of the execution of the relief of the oil pressure relief valve. With the foregoing, it is possible to prevent an increase in the oil pressure during the low oil temperature period, and thereby prevent deterioration of fuel efficiency during the low oil temperature period.

In the third aspect of the invention, when the oil has the middle oil temperature, the temperature-sensitive relief valve performs the oil relief such that the amount of the oil relief is increased in the vicinity of the low oil temperature and is reduced in the vicinity of the high oil temperature. The middle oil temperature denotes a temperature range between the low oil temperature and the high oil temperature. Accordingly, a large temperature difference is present between a low oil temperature side and a high oil temperature side in the middle oil temperature. With this, a large difference in the viscosity of oil occurs in the middle oil temperature range.

Consequently, in the middle oil temperature, the viscosity of oil is higher and the oil pressure is increased as the oil temperature is lower, and the viscosity is lower and the oil pressure is reduced as the oil temperature is higher. To cope with this, in the middle oil temperature, the control in which the relief amount is increased is performed in the range in which the oil temperature is low, and hence the oil pressure is not increased even when the oil temperature is reduced, it is possible to maintain the discharge pressure at a substantially constant low oil pressure, and the deterioration of fuel efficiency is not caused.

In the fourth aspect of the invention, when the oil has the high oil temperature, the temperature-sensitive relief valve does not perform the oil relief. With this, it is possible to facilitate cooling and lubrication. In the fifth aspect of the invention, by adopting the configuration in which the temperature-sensitive relief valve is provided in the engine, the temperature-sensitive relief valve is provided at an upstream position closest to the main gallery as an oil path disposed in a cylinder block, it is not necessary to additionally prepare a valve housing for the temperature-sensitive relief valve by mounting the temperature-sensitive relief valve to the cylinder block of the engine, the cylinder block of the engine can function as the housing for the temperature-sensitive relief valve, and it is possible to implement a reduction in the size of the device and a reduction in the number of components.

In the sixth aspect of the invention, it is possible to make the configuration of the temperature-sensitive relief valve extremely simple and compact, and provide the entire device of the present invention at a low price. In the seventh aspect of the invention, it is possible to configure the temperature-sensitive relief valve in which commonality of components is achieved for oil pumps having different capabilities and sizes and, therefore, it is possible to provide the device of the present invention at a low price. In addition, in the mounting of the temperature-sensitive relief valve to the pump housing, it is possible to mount the temperature-sensitive relief valve without the need of considering the positions of the inflow hole of the temperature-sensitive valve portion and the second relief outflow portion of the temperature-sensitive housing or a phase relationship therebetween. In the eighth aspect of the invention, it is possible to facilitate the detection of the change in the oil temperature in the temperature-sensitive relief valve to speed up the response of the temperature-sensitive relief valve. In the ninth aspect of the invention, even when the flow is bent such that the flow of the oil is concentrated at the temperature-sensitive relief valve, it is possible to minimize the turbulence of the flow of the oil.

BRIEF DESCRIPTION OF DRAWINGS

FIG. 10(A) is a plan view of an embodiment having a configuration in which an oil pressure relief valve and a temperature-sensitive relief valve are incorporated into an oil pump in the present invention, FIG. 10(B) is a cross-sectional view taken along arrows Y1-Y1 of FIG. 10(A), FIG. 10(C) is a partially cross-sectional view of an (α) portion of FIG. 10(A), and FIG. 10(D) is an enlarged view of a (β) portion of FIG. 10(B).

DESCRIPTION OF EMBODIMENTS

Figure 8:
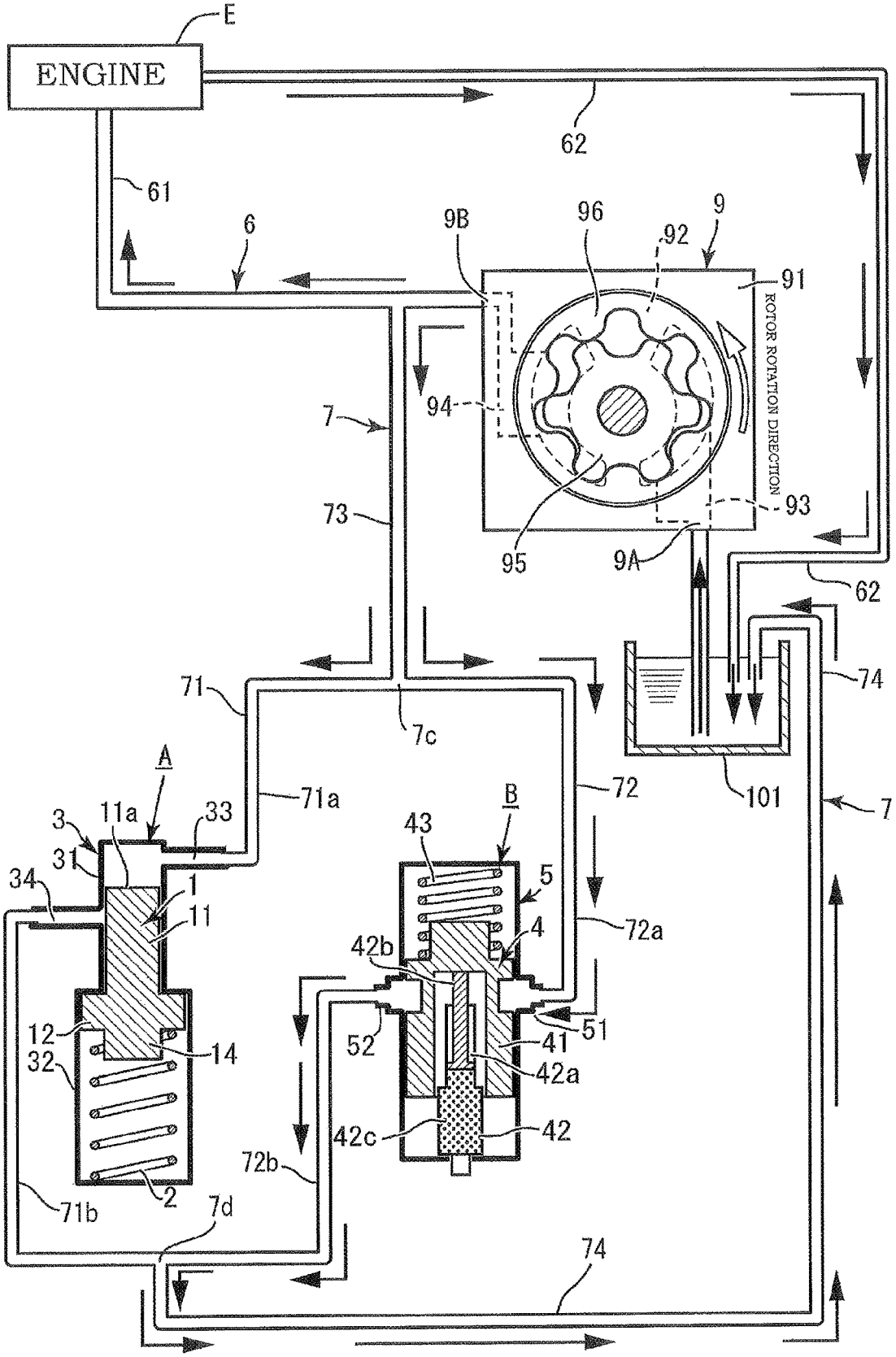
FIG. 8 is a schematic view showing the configuration of the oil circulation circuit of the engine having the relief flow path of a second embodiment in the present invention.

Embodiments of the present invention will be described based on the drawings. The present invention mainly includes an oil pressure relief valve A, a temperature-sensitive relief valve B, an oil circulation circuit 6, an upstream flow path 61, a downstream flow path 62, and an oil pump 9 (see FIGS. 1 and 8). The oil pressure relief valve A performs a relief (discharge) operation with discharge pressure from the oil pump 9. The oil pressure relief valve A is constituted by a valve body 1, an elastic member 2, and a valve housing 3 (see FIGS. 1 and 8).

The valve body 1 is constituted by a cylindrical small-diameter portion 11 and a cylindrical large-diameter portion 12, and they are coaxially formed integrally with each other in an axial direction. The small-diameter portion 11 is formed to be longer in the axial direction so as to be substantially columnar, and the large-diameter portion 12 is formed into a flat cylindrical shape. The end surface of one end of the small-diameter portion 11 in the axial direction (the upper end surface of the valve body 1 in FIG. 1) serves as a pressure reception surface 11*a*.

Figure 1:
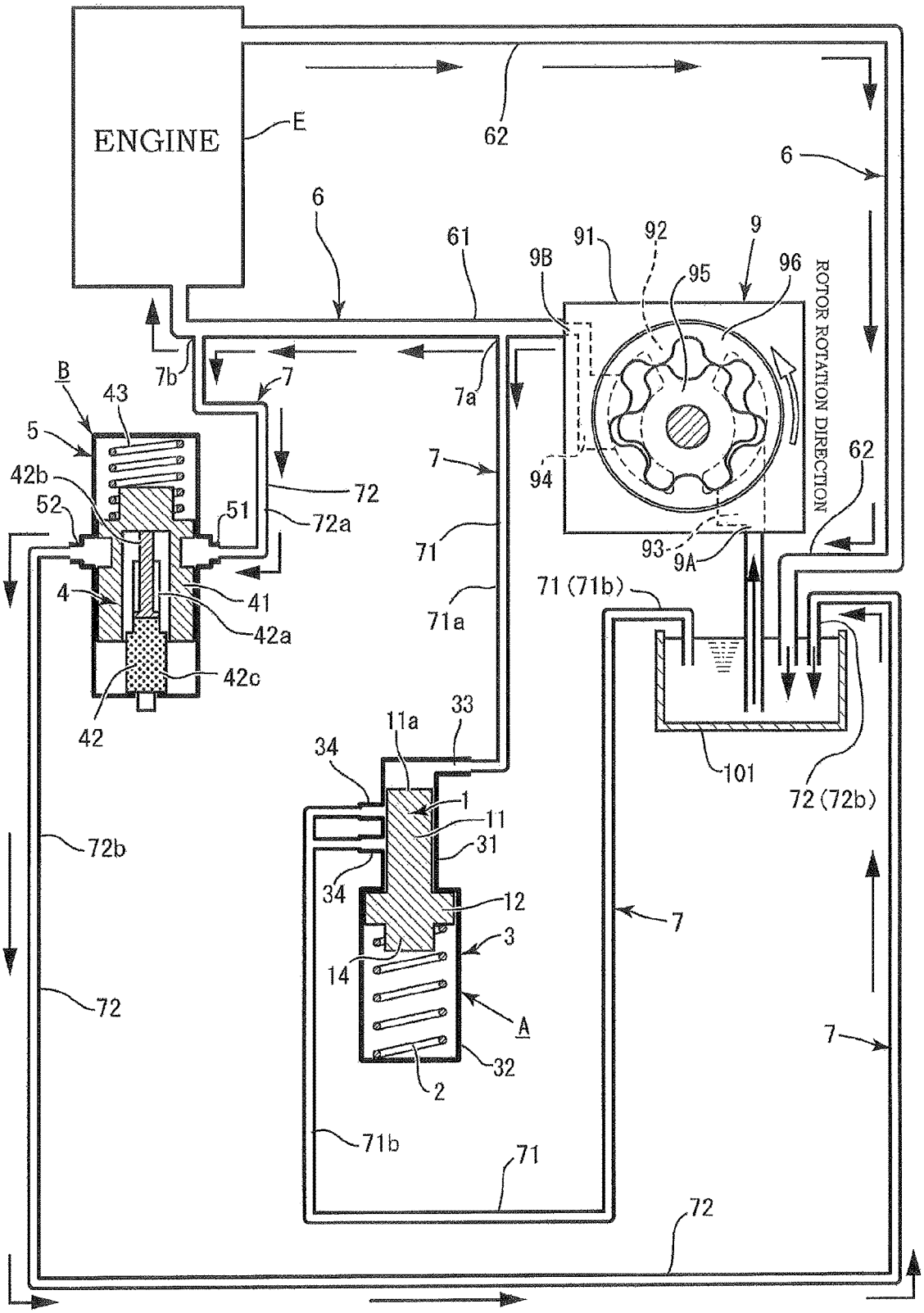
FIG. 1 is a schematic view showing the configuration of an oil circulation circuit of an engine having a relief flow path of a first embodiment in the present invention.

A cylindrical protruding portion 14 is formed at the other end of the large-diameter portion 12 in the axial direction (the lower end surface of the valve body 1 in FIG. 1). The protruding portion 14 plays a role in supporting the elastic member 2 such as a coil spring, and the protruding portion 14 is configured to be inserted into the elastic member 2 as the coil spring.

The valve housing 3 is constituted by a small-diameter valve chamber 31 and a large-diameter valve chamber 32. The small-diameter valve chamber 31 is a valve chamber in which the small-diameter portion 11 of the valve body 1 slides, and the large-diameter valve chamber 32 is a valve chamber in which the large-diameter portion 12 slides. Note that only the small-diameter portion 11 slides in the small-diameter valve chamber 31 but, in the large-diameter valve chamber 32, the small-diameter portion 11 also enters together with the large-diameter portion 12.

A first relief inflow portion 33 is formed at the axial end portion of the small-diameter valve chamber 31 of the valve housing 3 (the location of the upper end of the valve housing 3 in FIG. 1). The first relief inflow portion 33 is disposed between the valve housing 3 and the top portion of the valve body 1, and plays a role in flowing oil into the oil pressure relief valve A.

In addition, a first relief outflow portion 34 is formed at an appropriate position between the axial halfway location of the small-diameter valve chamber 31 of the valve housing 3 and the location of the boundary of the large-diameter valve chamber 32. The first relief outflow portion 34 is opened and closed with reciprocative sliding movement of the small-diameter portion 11 of the valve body 1, and plays a role in discharging oil to the outside from the valve housing 3 to return the oil to the intake side of the oil pump 9 or an oil pan 101 when the first relief outflow portion 34 is opened. The oil pressure relief valve A is not limited to the above configuration, and may have any configuration as long as the oil pressure relief valve A senses the pressure of oil and operates.

There are cases where two first relief outflow portions 34 are provided. In these cases, the two first relief outflow portions 34 are disposed at a predetermined interval in the movement direction of the valve body 1. It becomes possible to perform finer oil pressure control by providing the two first relief outflow portions 34.

The temperature-sensitive relief valve B is constituted by a temperature-sensitive valve body 4 and a temperature-sensitive housing 5. The temperature-sensitive valve body 4 is constituted by a temperature-sensitive valve portion 41 and a temperature-sensitive drive portion 42, and the temperature-sensitive drive portion 42 detects the temperature of oil and causes the temperature-sensitive valve portion 41 to slide in the temperature-sensitive housing 5. A second relief inflow portion 51 and a second relief outflow portion 52 are formed in the temperature-sensitive housing 5.

Herein, the conventional temperature-sensitive relief valve having a temperature sensor is designed such that a difference in the change of the oil temperature from the start of the operation to the end thereof is about 5° C. to 10° C. However, in the temperature-sensitive relief valve B in the present invention, the difference in the temperature from the start of the operation for performing oil relief to the end thereof is further increased. Specifically, the temperature-sensitive relief valve B starts the operation at about 50° C. (about 40° C. on an as needed basis), and ends the operation at about 120° C. (about 140° C. on an as needed basis), and the difference in the oil temperature is about 70° C. (or about 100° C.)

Thus, the temperature range of execution of the operation for performing the oil relief by the temperature-sensitive relief valve B in the present invention is increased to be wider than the conventional temperature range. In addition, the temperature-sensitive valve portion 41 is configured to be able to gradually move from a start end portion to a terminal end portion in its movement direction as the oil temperature rises. That is, unlike the conventional ON/OFF control, it is possible to perform control in which the oil temperature is followed in a wider oil temperature range.

The temperature-sensitive drive portion 42 also plays a role as the temperature sensor. Specifically, the temperature-sensitive drive portion 42 is a cylinder-type member, and is constituted by a cylinder 42*a* and a piston 42*b*. A temperature sensor 42*c* is provided in the cylinder 42*a*. As the temperature sensor 42*c*, thermowax is used. Specifically, a portion filled with the thermowax is provided in the cylinder 42*a* (see FIG. 1), expansion and thermal contraction are performed according to the level of the temperature detected by the thermowax, and the piston 42*b* performs extension/retraction operations with respect to the cylinder 42*a*.

By adopting the configuration in which the thermowax is used as the temperature sensor 42*c*, it is possible to make the device inexpensive. In addition, the thermowax can expand and contract substantially accurately, and the temperature-sensitive valve body 4 can thereby operate more smoothly.

As described above, the temperature-sensitive relief valve B is capable of performing the control in which the oil temperature is followed in the wide oil temperature range instead of the conventional ON/OFF control. In addition, in the temperature-sensitive valve body 4 of the temperature-sensitive relief valve B, the extension/retraction amount thereof gradually changes with respect to the change in the level of the oil temperature. That is, the temperature-sensitive valve body 4 closes so as to gradually narrow openings of the second relief inflow portion 51 and the second relief outflow portion 52 with the rise of the oil temperature of oil, and is configured to be capable of gradually reducing the amount of oil that flows via the second relief inflow portion 51 and the second relief outflow portion 52.

In addition, when the oil temperature decreases, the temperature-sensitive valve body 4 opens such that opening areas of the second relief inflow portion 51 and the second relief outflow portion 52 are gradually increased from their fully closed states to gradually increase the relief amount of oil. That is, the temperature-sensitive drive portion 42 that controls the operation of the temperature-sensitive valve body 4 is not configured to simply bring the second relief inflow portion 51 and the second relief outflow portion 52 into the fully opened state or the fully closed state according to the level of the oil temperature of oil.

In the present invention, in addition to the fully opened state and the fully closed state of the second relief inflow portion 51 and the second relief outflow portion 52, it is possible to bring the second relief inflow portion 51 and the second relief outflow portion 52 into a state between the fully opened state and the fully closed state. That is, the temperature-sensitive valve body 4 is capable of optimizing the opening area of each of the second relief inflow portion 51 and the second relief outflow portion 52 in accordance with the oil temperature.

With the structure described above, the temperature-sensitive valve portion 41 reciprocates in the temperature-sensitive housing 5 with the change in the level of the oil temperature. At this point, in the case where the oil has a low oil temperature, the second relief inflow portion 51 and the second relief outflow portion 52 are fully opened, and the relief amount of the oil that passes through the temperature-sensitive relief valve B is maximized. In the case where the oil has a high oil temperature, the second relief inflow portion 51 and the second relief outflow portion 52 are fully closed, and the oil relief by the temperature-sensitive relief valve B is not performed.

In the case where the oil temperature has a middle oil temperature, the opening area of each of the second relief inflow portion 51 and the second relief outflow portion 52 is slightly smaller than that in the fully opened state on a low oil temperature side in a middle oil temperature range. In addition, on a high oil temperature side in the middle oil temperature range, the second relief inflow portion 51 and the second relief outflow portion 52 are not fully closed, but are opened with small opening areas.

That is, in the case where the oil has the middle oil temperature, it is possible to increase the relief amount of the oil on the low oil temperature side, and reduce the relief amount of the oil on the high oil temperature side. Thus, in the case where the oil has the middle oil temperature, it is possible to adjust the level of the relief amount of the oil steplessly.

The thermowax is used as the temperature sensor 42*c* in the temperature-sensitive drive portion 42, but the temperature-sensitive drive portion 42 is not limited thereto, and there are cases where, e.g., a shape-memory alloy or a bimetal is used. The thermowax, the shape-memory alloy, the bimetal or the like used in the temperature-sensitive drive portion 42 does not use any electrical system, and it is referred to as a non-electronic control component in the present invention. By using the non-electronic control component in the temperature-sensitive drive portion 42 in the temperature-sensitive relief valve B, a component of an electronic control system is not used, and hence it is possible to achieve a stable operation without any effect resulting from the trouble of the electrical system.

In addition, the temperature-sensitive valve portion 41 includes an auxiliary elastic member 43 such as a coil spring that applies a load in a direction opposite to the direction of a load of the temperature-sensitive drive portion 42 and in a direction in which the second relief inflow portion 51 and the second relief outflow portion 52 are caused to constantly communicate with each other.

Thus, by using the non-electronic control component in the temperature sensor 42*c* of the temperature-sensitive relief valve B, the component of the electronic control system is not used, and hence it is possible to achieve the stable operation without any effect resulting from the trouble of the electrical system.

The oil pump 9 is an internal gear pump, and is constituted by a pump housing 91, an inner rotor 95, and an outer rotor 96. A rotor chamber 92 is formed in the pump housing 91, and an intake port 93 and a discharge port 94 are formed. In the pump housing 91, a side on which the intake port 93 is formed is referred to as an intake portion 9A, and a side on which the discharge port 94 is formed is referred to as a discharge portion 9B. The intake portion 9A has a configuration that includes an intake opening of the intake port 93 together with the intake port 93, and the discharge portion 9B has a configuration that includes a discharge opening of the discharge port 94 together with the discharge port 94.

In the rotor chamber 92 described above, the inner rotor 95 and the outer rotor 96 are disposed. An external gear is formed in the inner rotor 95, an internal gear is formed in the outer rotor 96, the inner rotor 95 is disposed in the outer rotor 96, the inner rotor 95 is driven to rotate with the outer rotor 96, and oil taken in from the intake port 93 is discharged from the discharge port 94.

The oil pump 9 is incorporated into the oil circulation circuit 6. The oil circulation circuit 6 supplies lubricant to an engine E of an automobile or the like using the oil pump 9. In the oil circulation circuit 6, a flow path from the discharge portion 9B of the oil pump 9 to the engine E is referred to as the upstream flow path 61, and a flow path from the engine E to the intake portion 9A of the oil pump 9 is referred to as the downstream flow path 62. In addition, there are cases where the oil pan 101 is provided in the downstream flow path 62, and the downstream flow path 62 communicates with the intake portion 9A of the oil pump 9 via the oil pan 101.

A relief flow path 7 is provided between the oil pump 9 and the engine E, i.e., between the halfway location of the upstream flow path 61 of the oil circulation circuit 6 and the intake portion 9A of the oil pump 9. In the relief flow path 7, the oil pressure relief valve A and the temperature-sensitive relief valve B are provided so as to be disposed in parallel.

The configuration of the relief flow path 7 has two embodiments. In a first embodiment, the relief flow path 7 is divided into a first relief branch flow path 71 that branches off from the upstream flow path 61 via a first branch portion 7*a* at a position close to the side of the oil pump 9, and a second relief branch flow path 72 that branches off therefrom via a second branch portion 7*b* at a position close to the side of the engine E (see FIG. 1).

The first relief branch flow path 71 and the second relief branch flow path 72 are disposed in parallel, the oil pressure relief valve A is provided in the first relief branch flow path 71, and the temperature-sensitive relief valve B is provided in the second relief branch flow path 72. With this configuration, the oil pressure relief valve A and the temperature-sensitive relief valve B are disposed in parallel.

A flow path on the upstream side of the position where the oil pressure relief valve A is provided in the first relief branch flow path 71 is referred to as a first upstream branch flow path 71*a* of the first relief branch flow path 71, and a flow path on the downstream side thereof is referred to as a first downstream branch flow path 71*b* thereof. The first relief inflow portion 33 of the oil pressure relief valve A is connected to the first upstream branch flow path 71*a*, and the first relief outflow portion 34 thereof is connected to the first downstream branch flow path 71*b* (see FIG. 1).

Similarly, a flow path on the upstream side of the position where the temperature-sensitive relief valve B is provided in the second relief branch flow path 72 is referred to as a second upstream branch flow path 72*a* of the second relief branch flow path 72, and a flow path on the downstream side thereof is referred to as a second downstream branch flow path 72*b* thereof. The second relief inflow portion 51 of the temperature-sensitive relief valve B is connected to the second upstream branch flow path 72*a*, and the second relief outflow portion 52 thereof is connected to the second downstream branch flow path 72*b* (see FIG. 1).

The first relief branch flow path 71 and the second relief branch flow path 72 are capable of sending oil to the side of the intake portion 9A of the oil pump 9 via the oil pan 101. In a second embodiment of the relief flow path 7, one upstream common flow path 73 that communicates with the side of the intake portion 9A of the oil pump 9 from the halfway location of the upstream flow path 61 of the oil circulation circuit 6 is provided, an upstream forked branch portion 7*c* is provided from the upstream common flow path 73, and the first relief branch flow path 71 and the second relief branch flow path 72 are provided from the upstream forked branch portion 7*c* so as to be disposed in parallel (see FIG. 8).

The oil pressure relief valve A is provided on one side of each of the first relief branch flow path 71 and the second relief branch flow path 72, and the temperature-sensitive relief valve B is provided on the other side thereof. A downstream forked confluence portion 7*d* is provided at the downstream end portion of each of the first relief branch flow path 71 and the second relief branch flow path 72, and a downstream common flow path 74 is provided from the downstream forked confluence portion 7*d*. The downstream common flow path 74 communicates with the intake portion 9A of the oil pump 9 via the oil pan 101.

Thus, in the second embodiment of the relief flow path 7, the first relief branch flow path 71 and the second relief branch flow path 72 are provided so as to be forked at the upstream end portions and the downstream end portions, and the oil pressure relief valve A and the temperature-sensitive relief valve B are disposed in parallel in the first relief branch flow path 71 and the second relief branch flow path 72.

In the upstream flow path 61 of the oil circulation circuit 6 of the first embodiment, the oil pressure relief valve A is provided at a position close to the side of the oil pump 9, and the temperature-sensitive relief valve B is provided at a position close to the side of the engine E and, in particular, the temperature-sensitive relief valve B is preferably provided at an upstream position closest to or immediately before the main gallery of the engine E. With this, it is possible to perform the control of the temperature-sensitive relief valve B with the oil temperature closer to the oil temperature of the main gallery of the engine E, and perform accurate control.

Although not particularly shown in the drawings, the engine E is constituted by a cylinder head and a cylinder block and, in the cylinder block, the main gallery as the most downstream portion of the upstream flow path 61 (i.e., an oil path provided in the engine E) is formed.

There are cases where the temperature-sensitive relief valve B is incorporated into the cylinder block so as to be integrated with the engine E, and the oil pressure relief valve A is integrated with the oil pump 9 and is incorporated into the pump housing 91. Even in this configuration, the oil pressure relief valve A and the temperature-sensitive relief valve B are disposed in parallel in the relief flow path 7.

The basic flow of oil in the oil circulation circuit 6 will be described. Oil discharged from the side of the discharge portion 9B of the oil pump 9 flows to the oil circulation circuit 6, and the oil for lubrication and cooling is supplied to the engine E via the upstream flow path 61. Subsequently, the oil having circulated in the engine E flows in the downstream flow path 62, and returns to the side of the intake portion 9A of the oil pump 9 again. At this point, when the oil pan 101 is provided between the downstream flow path 62 and the intake portion 9A of the oil pump 9, the oil is stored in the oil pan 101 (see FIG. 1).

Next, the relief operation of a relief device in the present invention will be described. As described above, in the relief flow path 7 in which oil relief is performed, the oil pressure relief valve A and the temperature-sensitive relief valve B are disposed in parallel, and perform the relief operations independently of each other. The oil pressure relief valve A and the temperature-sensitive relief valve B individually operate in accordance with an increase in the discharge pressure of oil from the oil pump 9 or the level of the oil temperature.

Hereinbelow, the relief operation of oil in the following case will be described in accordance with the level of the oil temperature and the level of the rpm of the engine E. Herein, it is assumed that the low oil temperature of the oil temperature denotes the case where the oil temperature is not more than about 50° C., and the low oil temperature has a temperature range lower than about 40° C. to about 60° C. The middle oil temperature usually denotes a range from about 40° C. to about 130° C. but, in the present invention, it is assumed that the middle oil temperature denotes a range from about 50° C. to about 120° C. In addition, it is assumed that the high oil temperature is not less than about 120° C. In FIGS. 1 to 8, each arrow shown along the oil circulation circuit 6 and the relief flow path 7 indicates the flow of oil and its direction.

Figure 2:
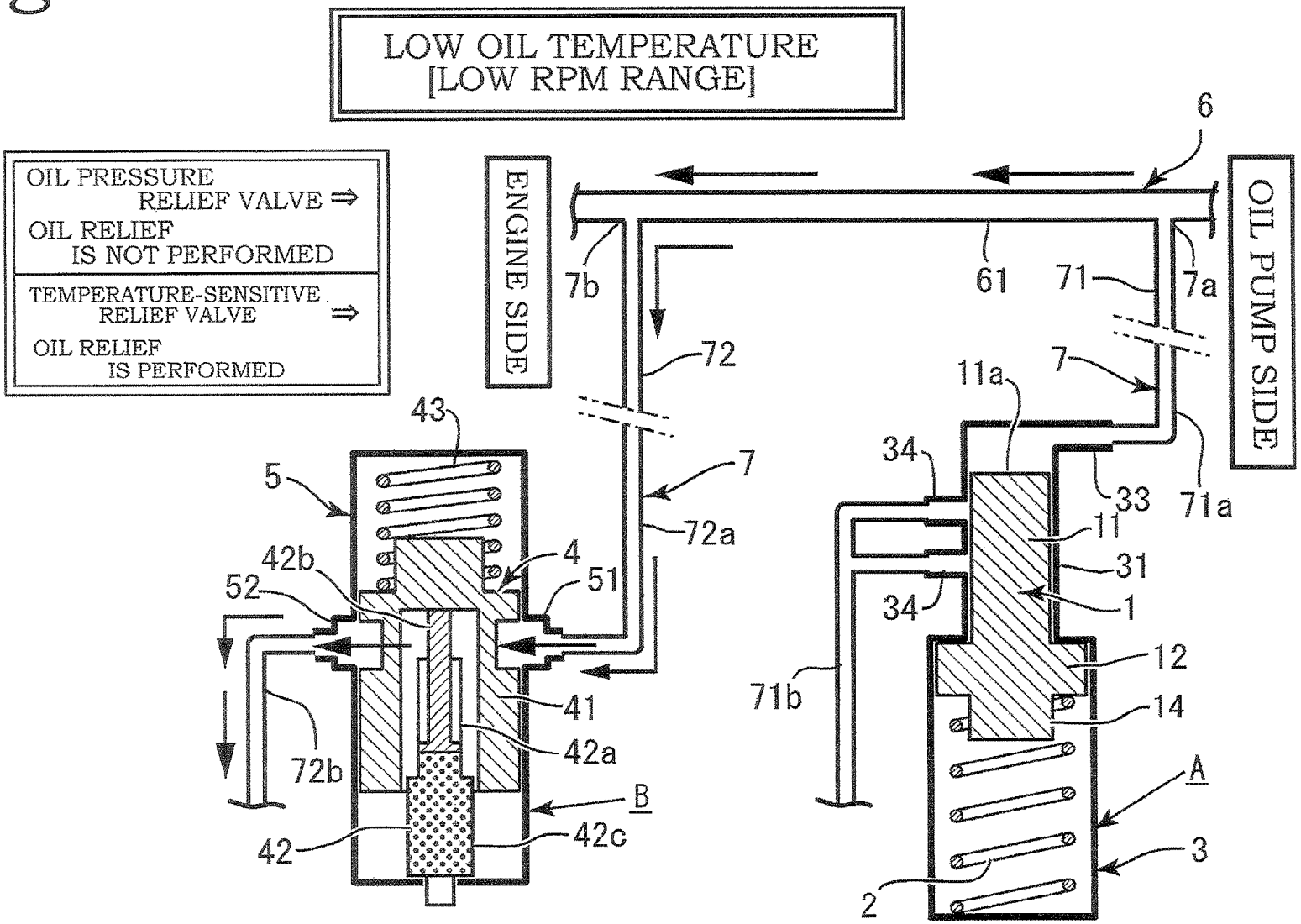
FIG. 2 is an enlarged schematic view showing an oil relief operation at a low oil temperature in a low rpm range of an engine.

The relief operation of oil when the oil has the low oil temperature and the engine E is in a low rpm range is as follows (see FIG. 2). The temperature-sensitive relief valve B performs the oil relief, and the oil pressure relief valve A does not perform the oil relief. A specific example of such a situation includes the case where oil is not warmed adequately immediately after the start of the engine E. Consequently, the oil has the low oil temperature, and the viscosity of the oil is high.

The oil pressure is low, and hence the relief operation by the oil pressure relief valve A is not performed. In contrast to this, in the temperature-sensitive relief valve B, when the oil temperature is low, the valve body 4 opens such that the second relief inflow portion 51 and the second relief outflow portion 52 communicate with each other, the oil flows in the second relief branch flow path 72, and the relief is performed.

Figure 3:
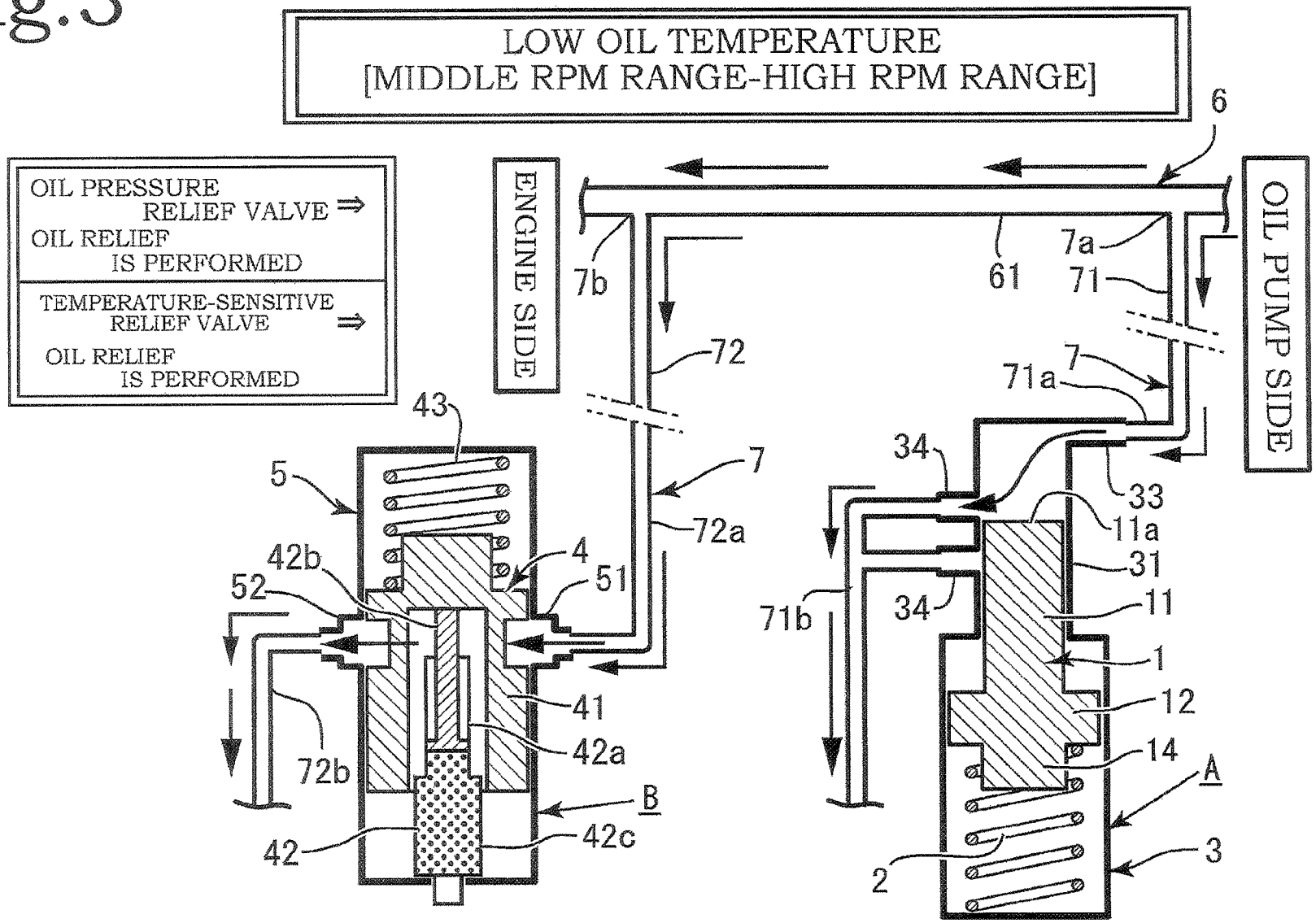
FIG. 3 is an enlarged schematic view showing the oil relief operation at the low oil temperature in a middle rpm range of the engine to a high rpm range thereof.

The relief operation of oil when the oil has the low oil temperature and the engine E is in a middle rpm range or a high rpm range is as follows (see FIG. 3). Each of the temperature-sensitive relief valve B and the oil pressure relief valve A performs the oil relief. That is, in the state in which the engine E is in the middle rpm range or the high rpm range, the pressure of oil is high, and hence the oil pressure relief valve A operates and performs the relief with the oil pressure.

Figure 4A:
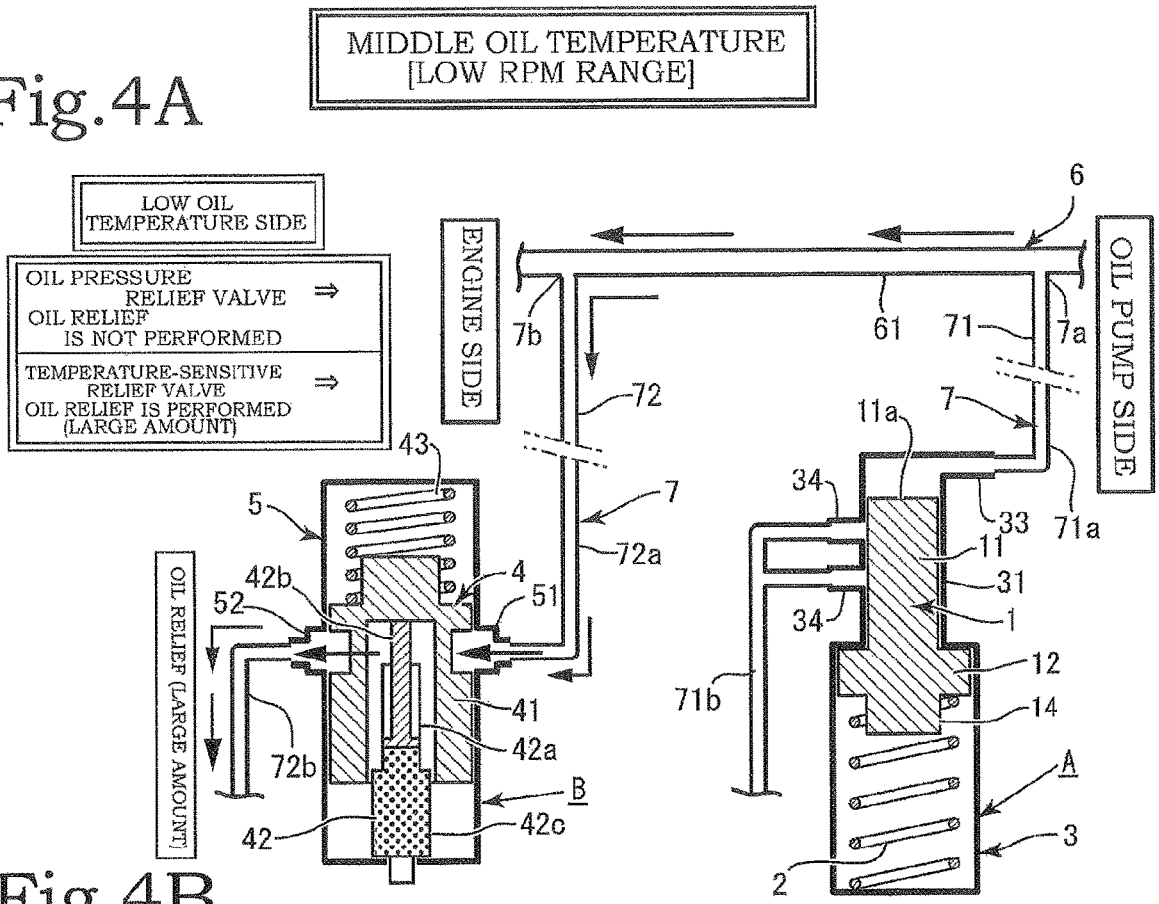
FIG. 4(A) is an enlarged schematic view showing the oil relief operation on a low oil temperature side in a middle oil temperature range in the low rpm range of the engine.
Figure 4B:
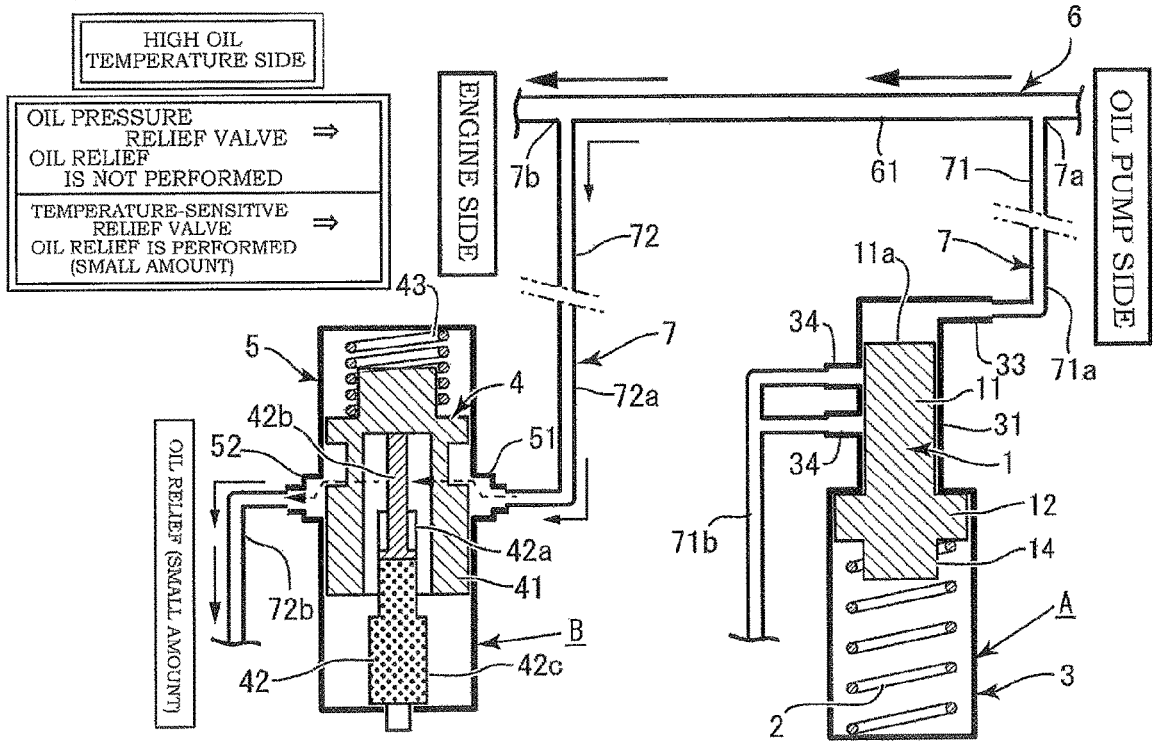
FIG. 4(B) is an enlarged schematic view showing the oil relief operation on a high oil temperature side in the middle oil temperature range in the low rpm range of the engine.

The relief operation of oil when the oil has the middle oil temperature and the engine E is in the low rpm range is as follows (see FIG. 4). The temperature-sensitive relief valve B performs the oil relief such that the relief amount of oil is increased on a low oil temperature side in the range of the middle oil temperature [see FIG. 4(A)]. In addition, the communication amount of the second relief inflow portion 51 and the second relief outflow portion 52 is reduced such that the relief amount of oil is reduced on a high oil temperature side in the range of the middle oil temperature. The engine E is in the low rpm range and the pressure of oil is low, and hence the oil pressure relief valve A does not perform the oil relief [see FIG. 4(B)].

Figure 5A:
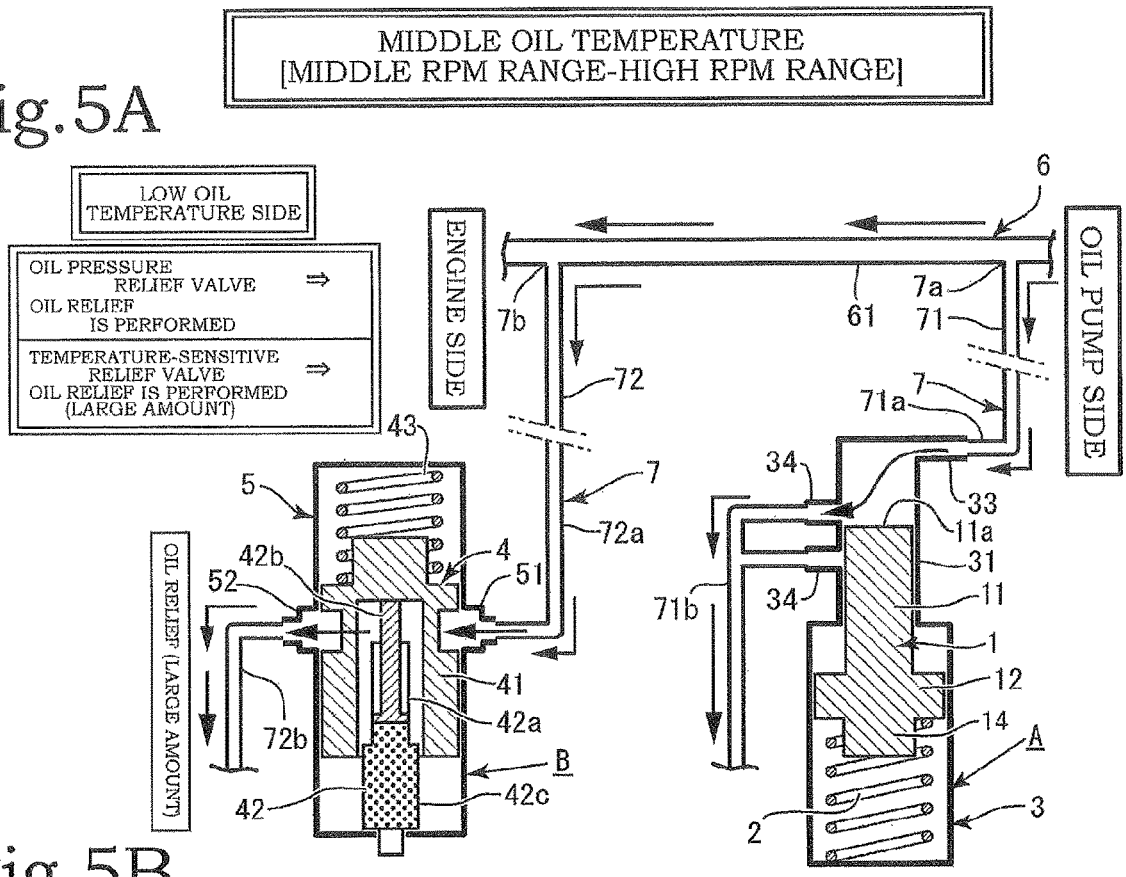
FIG. 5(A) is an enlarger schematic view showing the oil relief operation on the low oil temperature side in the middle oil temperature range in the middle rpm range of the engine to the high rpm range thereof.
Figure 5B:
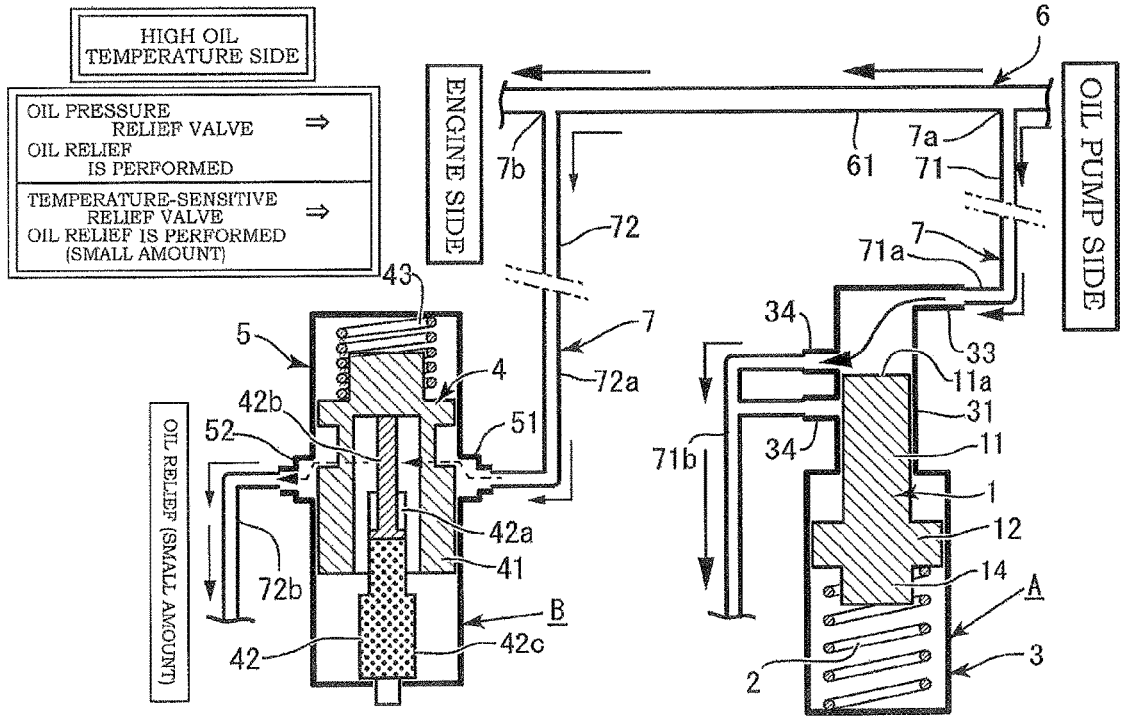
FIG. 5(B) is an enlarged schematic view showing the oil relief operation on the high oil temperature side in the middle oil temperature range in the middle rpm range of the engine to the high rpm range thereof.

The relief operation of oil when the oil has the middle oil temperature and the engine E is in the middle rpm range or the high rpm range is as follows (see FIGS. 5(A) and 5(B)). The temperature-sensitive relief valve B performs the oil relief such that the relief amount of oil is increased on the low oil temperature side in the range of the middle oil temperature [see FIG. 5(A)]. In addition, the temperature-sensitive relief valve B performs the oil relief such that the relief mount of oil is reduced on the high oil temperature side in the range of the middle oil temperature. The pressure of oil rises when the engine B is in the middle rpm range or the high rpm range, and hence the oil pressure relief valve A performs the oil relief [see FIG. 5(B)].

Figure 6:
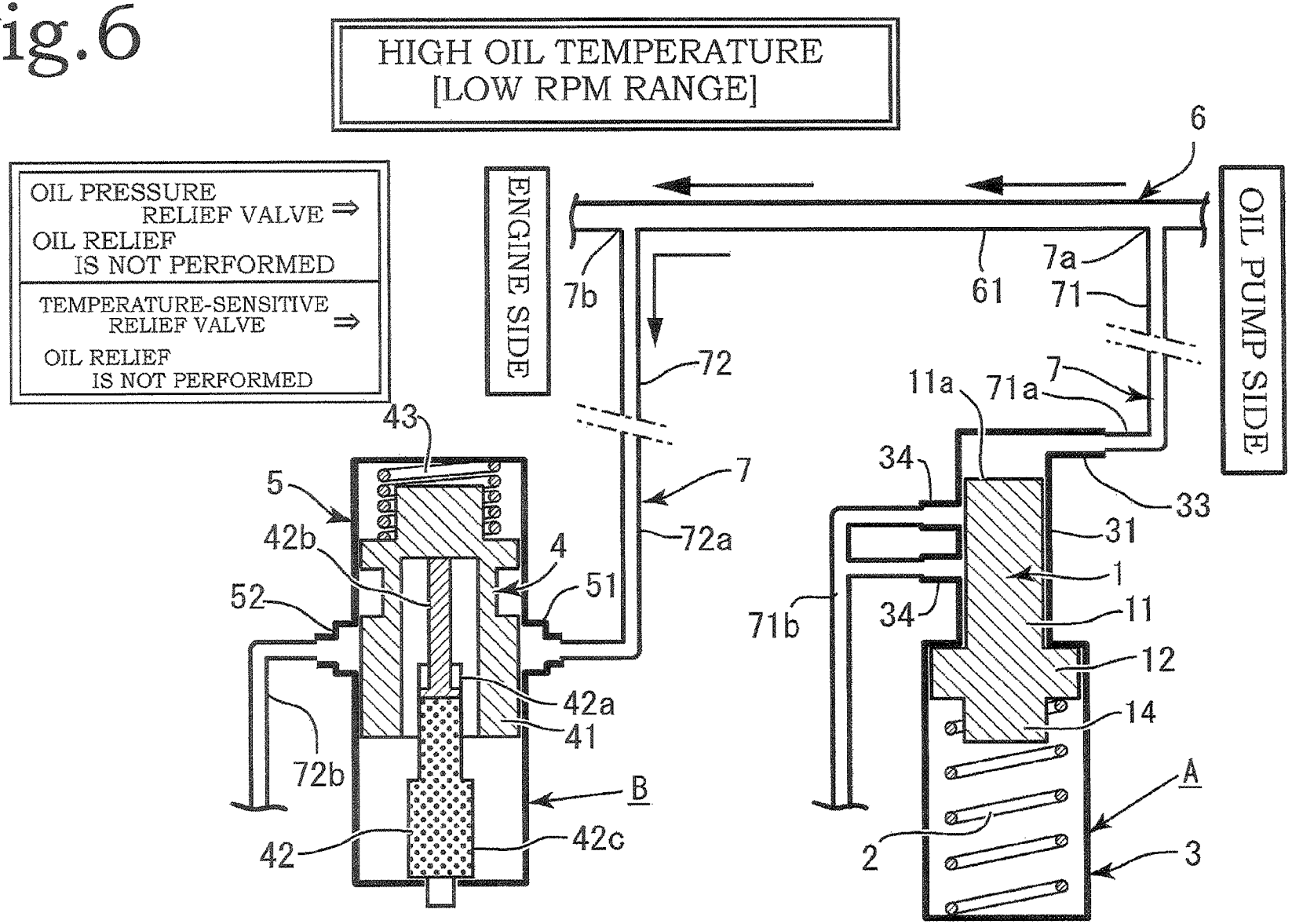
FIG. 6 is an enlarged schematic view showing the oil relief operation at a high oil temperature in the low rpm range of the engine.

The relief operation of oil when the oil has the high oil temperature and the engine E is in the low rpm range is as follows (see FIG. 6). The temperature-sensitive relief valve B fully closes and does not perform the oil relief at the high oil temperature. The engine E is in the low rpm range and the pressure of oil is low, and hence the oil pressure relief valve A does not perform the oil relief.

Figure 7:
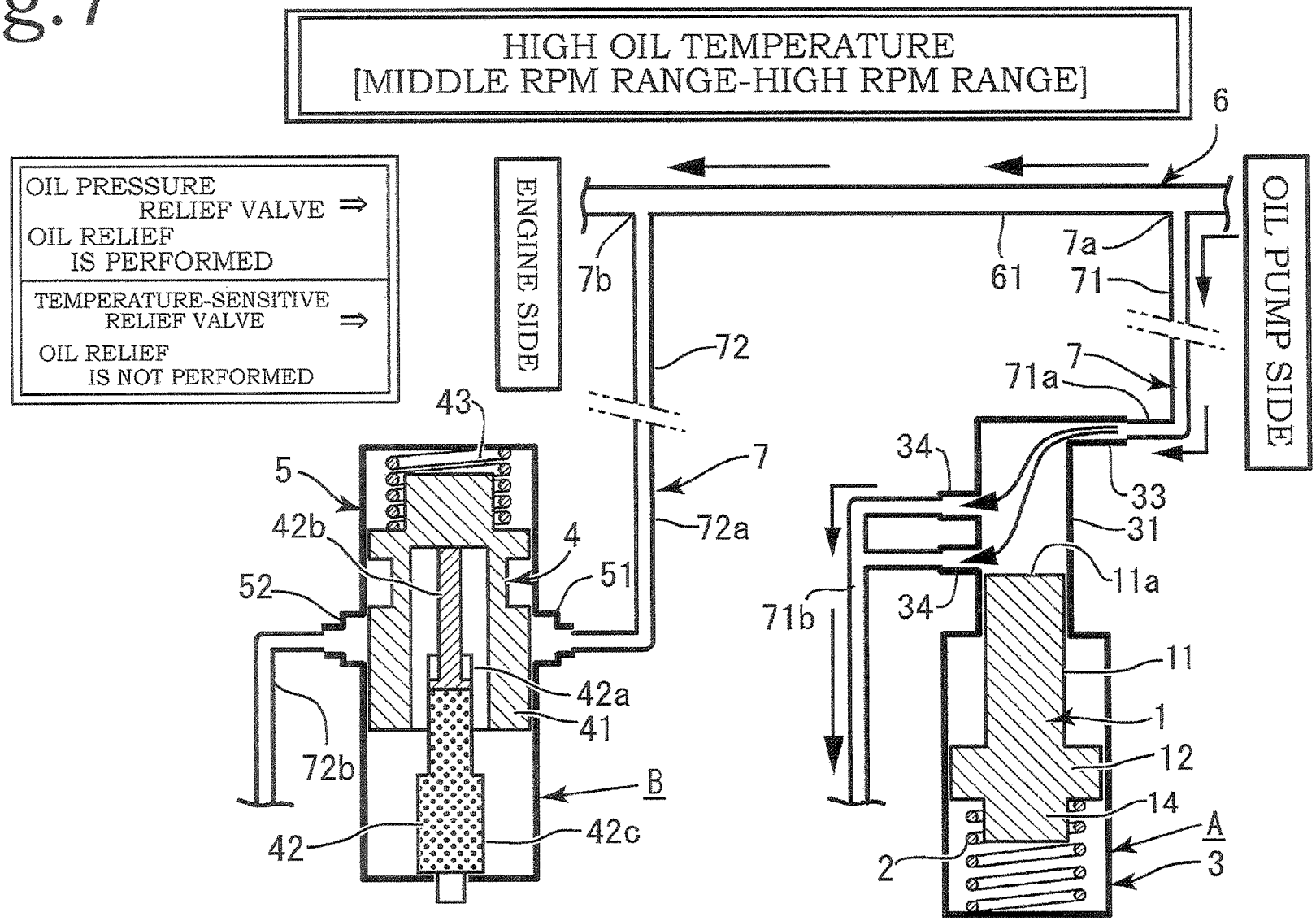
FIG. 7 is an enlarged schematic view showing the oil relief operation at the high oil temperature in the middle rpm range of the engine to the high rpm range thereof.

The relief operation of oil when the oil has the high oil temperature and the engine E is in the middle rpm range or the high rpm range is as follows (see FIG. 7). The temperature-sensitive relief valve B fully closes and does not perform the oil relief at the high oil temperature. The discharge pressure from the oil pump 9 is high, and hence the oil pressure relief valve A performs the oil relief.

Figure 9:
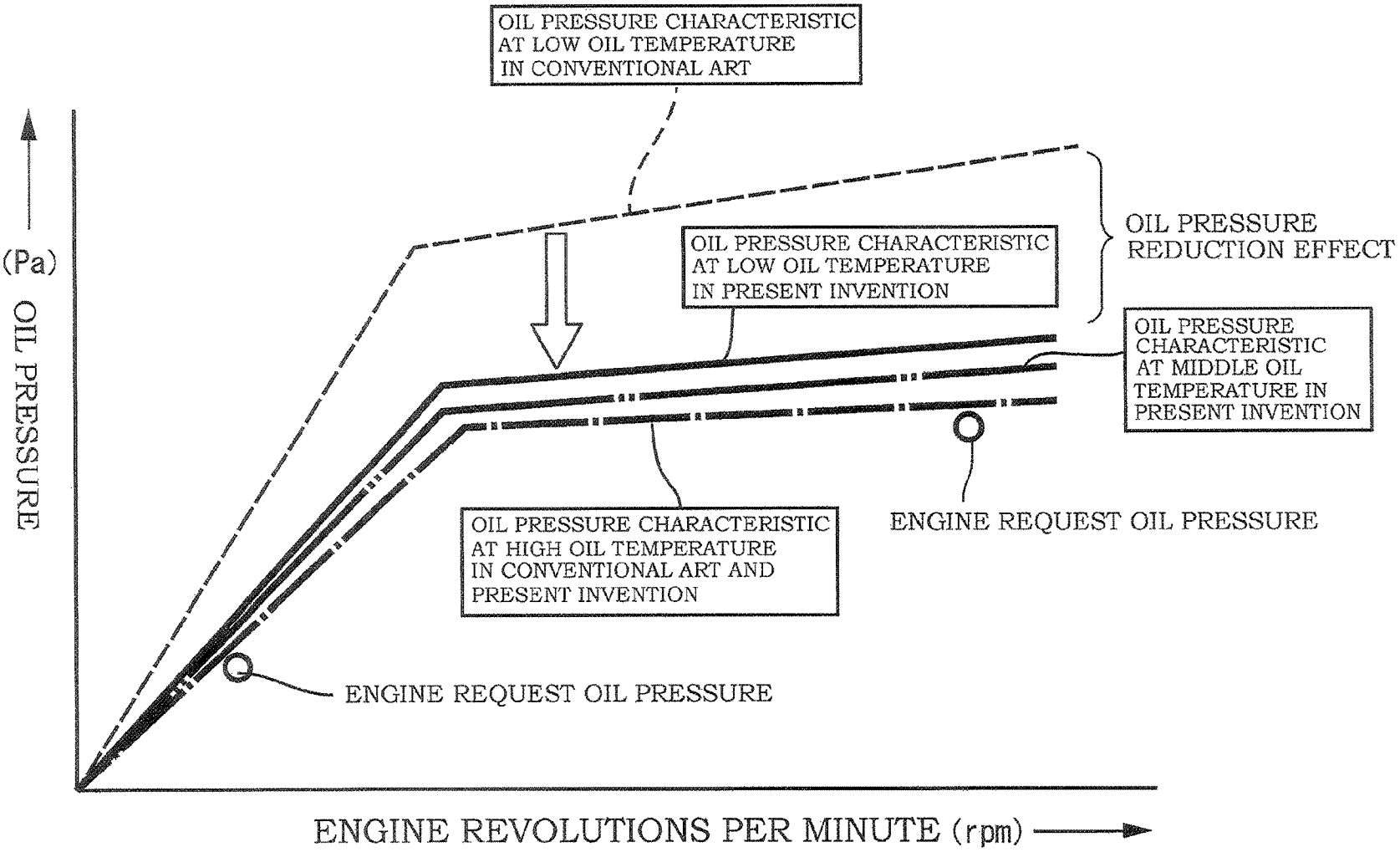
FIG. 9 is a graph showing characteristics of the present invention.

Thus, in the relief device in the present invention, the appropriate oil relief is performed in accordance with the situations based on the low oil temperature, the middle oil temperature, and the high oil temperature of oil, and the low rpm range, the middle rpm range, and the high rpm range of the engine E. With this, as shown in a graph indicative of oil pressure characteristics of the present invention (see FIG. 9), in the oil pressure characteristics of the present invention, it is possible to obtain a low oil pressure characteristic similar to that of the high oil temperature even when the oil has the low oil temperature or the middle oil temperature.

Hereinbelow, the principal configuration of the present invention will be described. In the relief flow path 7, the first relief branch flow path 71 and the second relief branch flow path 72 are provided so as to be disposed in parallel, the oil pressure relief valve A is provided in the first relief branch flow path 71, and the temperature-sensitive relief valve B is provided in the second relief branch flow path 72.

As the sensor (the temperature sensor 42*c*) of the temperature-sensitive relief valve B that senses the oil temperature, the non-electronic component is used. Further, in the temperature-sensitive relief valve B, the temperature-sensitive valve body 4 that senses the oil temperature and moves gradually and smoothly moves in response to the change in the level of the oil temperature.

As described above, the relief device in the present invention is characterized in that the temperature-sensitive relief valve B performs the oil relief when the oil has the low oil temperature, the temperature-sensitive relief valve B performs the oil relief such that the relief amount of oil is increased on the low oil temperature side and is reduced on the high oil temperature side when the oil has the middle oil temperature, and the temperature-sensitive relief valve B does not perform the oil relief when the oil has the high oil temperature.

In addition, the oil pump 9 is the internal gear pump in the embodiment of the present invention, but the oil pump 9 is not limited thereto, and an external gear pump, a vane pump or the like may also be used as the oil pump 9. That is, as long as the oil pump serves as an oil pressure generation source, the type of the oil pump may be any type.

Further, in the embodiment of the present invention, in order to make the control by the temperature sensor 42*c* more accurate and improve responsivity, the temperature sensor 42*c* may be disposed adjacent to the upstream flow path 61 or such that part of the temperature sensor 42*c* protrudes into the upstream flow path 61. In addition, in the second embodiment of the present invention, by adopting a structure in which the valve housing 3 and the temperature-sensitive housing 5 are formed integrally with each other by casting or the like, the number of components is reduced.

Next, the specific configuration of each of the oil pressure relief valve A and the temperature-sensitive relief valve B will be described. Herein, the oil pressure relief valve A and the temperature-sensitive relief valve B will be described as the structure of the oil pump 9 in which the oil pressure relief valve A and the temperature-sensitive relief valve B are incorporated into the pump housing 91 and are integrally combined into a unit [see FIG. 10(A)].

In addition, in order to facilitate understanding of the description, an up-and-down direction is set in the pump housing 91. The up-and-down direction of the pump housing 91 corresponds to a vertical direction when the direction of rotation of each of the inner rotor 95 and the outer rotor 96 is used as a vertical plane in FIG. 10(A). The up-and-down direction is described in FIG. 10. In the drawing, 98 denotes a drive shaft, and the drive shaft 98 rotates with the power of the engine E, and rotates the inner rotor 95 and the outer rotor 96.

As described above, the oil pressure relief valve A is constituted by the valve body 1, the elastic member 2, and the valve housing 3. The temperature-sensitive relief valve B is provided in the upstream flow path 61. The upstream flow path 61 is a flow path leading to the discharge portion 9B of the pump housing 91 and, herein, a structure is adopted in which the upstream flow path 61 is formed integrally in and incorporated into the pump housing 91 [see FIG. 10(A)].

A portion of the upstream flow path 61 that is formed in the pump housing 91 in this manner is referred to as an in-housing upstream flow path 611. The in-housing upstream flow path 611 is a flow path constituting the discharge portion 9B, and is an oil path to the discharge opening for discharging oil to the outside of the pump housing 91 from the discharge port 94. In addition, the in-housing upstream flow path 611 is a flow path that extends in a horizontal direction relative to the up-and-down direction of the pump housing 91 [see FIGS. 10(A) and 10(C), and FIG. 12].

The valve housing 3 is formed on the lower end surface of the in-housing upstream flow path 611, the valve body 1 and the elastic member 2 are mounted to the valve housing 3, and the valve body 1 is constantly biased upward elastically by the elastic member 2. The upper end location of the valve housing 3 is a part that intersects the in-housing upstream flow path 611, and has an opening 3*a*. The opening 3*a* is a portion used as a part corresponding to the relief flow path 7 and the first relief inflow portion 33.

That is, the parts of the first branch portion 7*a* of the relief flow path 7 and the upstream branch flow path 71*a* of the first relief branch flow path 71 are collectively provided in the opening 3*a*. The inner diameter of the part of the opening 3*a* of the valve housing 3 is formed to be smaller than the outer diameter of the valve body 1, and the valve body 1 is configured to be prevented from protruding upward from the opening 3*a*.

The first relief outflow portion 34 is formed at an appropriate position on an inner peripheral side surface 3*b* of the valve housing 3. The first relief outflow portion 34 is connected to the intake port 93, and relieved oil that flows out of the first relief outflow portion 34 is sent to the intake port 93 with the downstream branch flow path 71*b* of the first relief branch flow path 71. The downstream branch flow path 71*b* is formed integrally in the pump housing 91. The two first relief outflow portions 34 are provided in parallel along the up-and-down direction of the valve housing 3 [see FIG. 10(A)].

As described above, the temperature-sensitive relief valve B is constituted by the temperature-sensitive valve body 4 and the temperature-sensitive housing 5. The temperature-sensitive relief valve B is provided in the in-housing upstream flow path 611 adjacent to the oil pressure relief valve A on the downstream side. The temperature-sensitive housing 5 is formed so as to branch off from the in-housing upstream flow path 611.

The temperature-sensitive housing 5 is formed along the up-and-down direction of the pump housing 91, and is formed into cylindrical space by a cylindrical inner peripheral side surface 5*b* and a circular bottom surface 5*c*. The upper end location of the temperature-sensitive housing 5 is a part that intersects the in-housing upstream flow path 611 and has an opening 5*a*.

The opening 5*a* is a portion used as a part corresponding to the relief flow path 7 and the second relief inflow portion 51. That is, the parts of the second branch portion 7*b* of the relief flow path 7 and the second upstream branch flow path 72*a* of the second relief branch flow path 72 are collectively provided in the opening 5*a*. The second relief outflow portion 52 is formed at an appropriate position on the inner peripheral side surface 5*b*.

The second relief outflow portion 52 is connected to the oil pan 101 or the intake port 93, and relieved oil that flows out of the second relief outflow portion 52 is sent to the oil pan 101 or the intake port 93 with the second downstream branch flow path 72*b* of the second relief branch flow path 72. There are cases where the second downstream branch flow path 72*b* is formed integrally in the pump housing 91.

Figure 12:
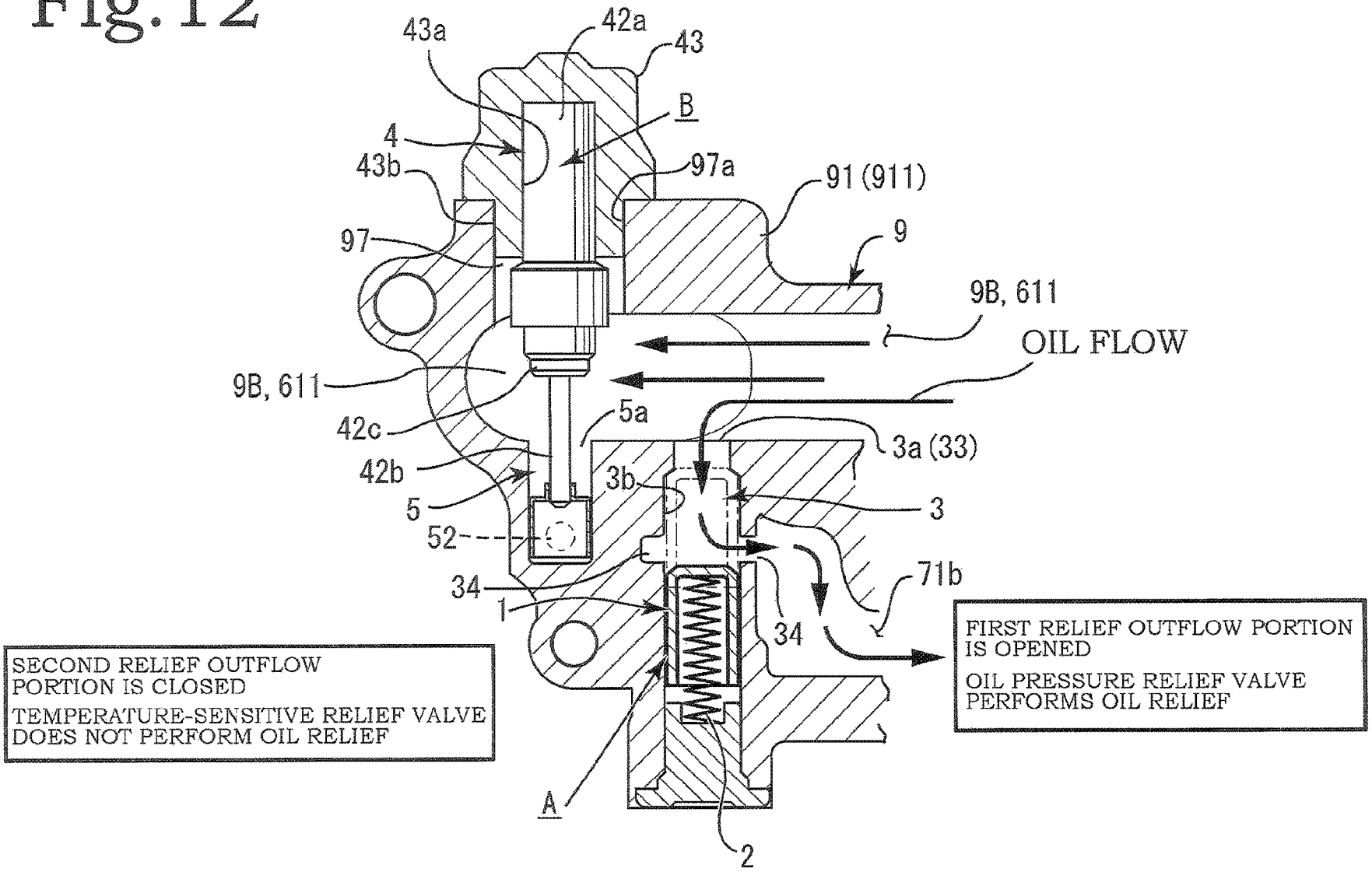
FIG. 12 is a partially cross-sectional enlarged view of the principal portion showing a state in which the temperature-sensitive valve does not perform the oil relief, and the oil relief is performed in the oil pressure relief valve.
Figure 13A:
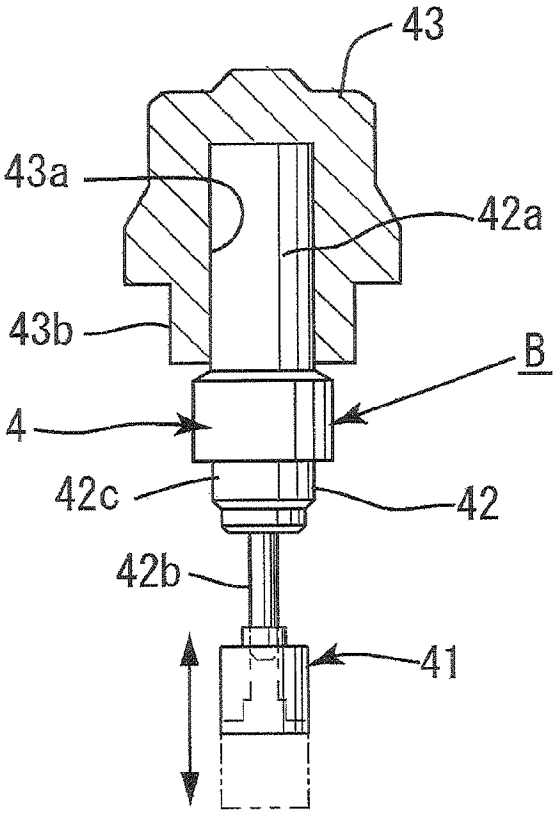
FIG. 13(A) is a partially cross-sectional side view showing the configuration of each of a temperature-sensitive drive portion and a temperature-sensitive valve portion in the temperature-sensitive relief valve.
Figure 13B:
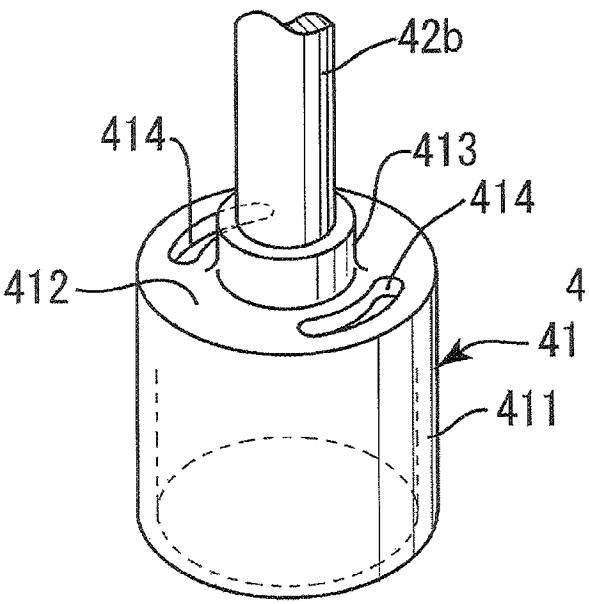
FIG. 13(B) is a perspective view of the temperature-sensitive valve portion having an oblong inflow hole.
Figure 13C:
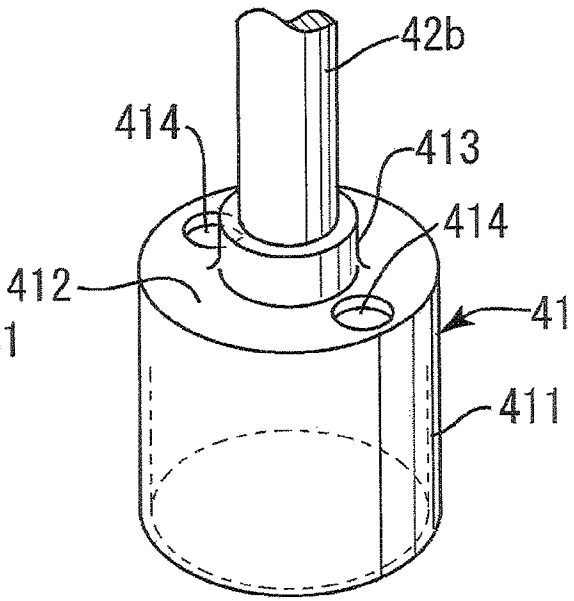
FIG. 13(C) is a perspective view of the temperature-sensitive valve portion having a circular inflow hole.

The temperature-sensitive valve portion 41 of the temperature-sensitive valve body 4 is formed of a cylindrical portion 411 and a top portion 412, and the top portion 412 is formed integrally with the upper end of the cylindrical portion 411 and is formed into a substantially cylindrical cup-like shape (see FIG. 12). The top portion 412 is formed with a connection portion 413 to which the shaft end of the piston 42*b* of the temperature-sensitive drive portion 42 is inserted and connected. The connection portion 413 is formed into a cylindrical shape into which the piston 42*b* can be inserted [see FIGS. 13(B) and 13(C)].

An inflow hole 414 is formed in the top portion 412 [see FIG. 10(D), FIG. 11, FIGS. 13(B) and 13(C), FIG. 14(A) and the like]. One or a plurality of the inflow holes 414 are formed at appropriate locations around the connection portion 413. The inflow hole 414 plays a role in sending oil to the temperature-sensitive housing 5 via the temperature-sensitive valve portion 41.

The inflow hole 414 has various shapes. A first shape thereof is an oblong shape [see FIG. 13(B)] or an oval shape. In the oblong inflow hole 414, the entire shape thereof is formed into a substantially arc shape. A second shape thereof is a circular shape [see FIG. 13(C)].

When two inflow holes 414 are formed, the two inflow holes 414 are preferably formed at positions symmetric with respect to the connection portion 413. The inflow hole 414 is formed to have the total area of its opening smaller than the opening area of the second relief outflow portion 52 [see FIG. 10(D), FIG. 11, FIGS. 13(B) and 13(C), FIG. 14(A) and the like].

In the case where the inflow hole 414 of the temperature-sensitive valve portion 41 and the second relief outflow portion 52 are disposed in series, the relief amount is determined substantially with one of the opening areas of the inflow hole 414 and the second relief outflow portion 52 that is smaller than the other one. In the case where the oil temperature is low, the second relief outflow portion 52 is fully opened.

Therefore, in the case where the oil temperature is low, it is possible to determine the relief amount only with the total area of the inflow hole 414 of the temperature-sensitive valve portion 41. In addition, when the oil temperature is high, the second relief outflow portion 52 in the temperature-sensitive housing 5 is fully closed by the temperature-sensitive valve portion 41, and hence it is possible to perform control in which the oil pressure reduction by the temperature-sensitive relief valve B is not performed.

As described above, the temperature-sensitive drive portion 42 is constituted by the cylinder 42*a* and the piston 42*b*, and the cylinder 42*a* is filled with the thermowax. The thermowax performs the expansion and the thermal contraction according to the level of the detected oil temperature, and the piston 42*b* performs the extension/retraction operations with respect to the cylinder 42*a*. The part that detects the oil temperature is the temperature sensor 42*c*.

The temperature-sensitive drive portion 42 is mounted to a position corresponding to a location at which the temperature-sensitive housing 5 is formed in the in-housing upstream flow path 611 [see FIG. 10(C) and FIG. 12]. In the in-housing upstream flow path 611, a mounting portion 97 to which the temperature-sensitive drive portion 42 is mounted is formed. Specifically, the mounting portion 97 as a gap in which the temperature-sensitive drive portion 42 can be disposed is formed at a position immediately above the location of formation of the temperature-sensitive housing 5 in the in-housing upstream flow path 611 [see FIG. 10(C) and FIG. 12].

The temperature-sensitive drive portion 42 is mounted to the mounting portion 97 via a holder 44. The holder 44 has a holding portion 44*a* that holds the temperature-sensitive drive portion 42 and an external thread 44*b*, and an internal thread 97*a* is formed in the mounting portion 97. The cylinder 42*a* of the temperature-sensitive drive portion 42 is mounted to the holding portion 44*a*, the external thread 44*b* engages with the internal thread 97*a*, and the temperature-sensitive drive portion 42 is mounted to the mounting portion 97. Positions at which the temperature-sensitive housing 5 and the temperature-sensitive drive portion 42 are provided are in the vicinity of a discharge side end portion of the in-housing upstream flow path 611 [see FIGS. 10(A) and 10(C), and FIG. 12].

Next, the operation of the temperature-sensitive relief valve B will be described. The inflow hole 414 is formed in the top portion 412 of the temperature-sensitive valve portion 41, and part of discharged oil that flows in the in-housing upstream flow path 611 constantly flows into the temperature-sensitive housing 5 from the inflow hole 414. The extension/retraction amount of the temperature-sensitive valve body 4 of the temperature-sensitive relief valve B gradually changes in response to the change in the level of the oil temperature. In the case of the low oil temperature, the piston 42*b* of the temperature-sensitive drive portion 42 positions the temperature-sensitive valve portion 41 at the upper portion of the temperature-sensitive housing 5, and the second relief outflow portion 52 is fully opened [see FIG. 11(A)].

With this, when the oil has the low oil temperature, the oil flows in the inflow hole 414 and the second relief outflow portion 52, and the relief of discharged oil is constantly performed. The inflow hole 414 formed in the top portion 412 is not formed at a position close to the outer periphery of the top portion 412, but is formed in an area close to the center of the top portion 412 so as to pass through the top portion 412 in the axial direction. That is, the inflow hole 414 does not intersect the outer periphery of the top portion 412, and is formed at a position spaced apart from the outer periphery.

This configuration is adopted in order to prevent part of the inflow hole 414 from intersecting the outer peripheral edge of the top portion 412 to form a groove in the side surface of the cylindrical portion 411. With this, when the temperature-sensitive valve portion 41 is mounted to the piston 42*b* of the temperature-sensitive drive portion 42 and the temperature-sensitive valve portion 41 is inserted into the temperature-sensitive housing 5, it is possible to mount the temperature-sensitive valve portion 41 at any angle on the horizontal plane with the piston 42*b* serving as the central axis without the need of considering the position or phase of the second relief outflow portion 52 in the temperature-sensitive housing 5, thereby simplifying a mounting operation. Further, in the mounting operation, it is not necessary to prepare a special jig or an angle (phase) measurement device.

With a rise of the oil temperature of oil in the in-housing upstream flow path 611, the temperature-sensitive valve portion 41 slides downward in the temperature-sensitive housing 5, and gradually narrows the opening of the second relief outflow portion 52. With this, the amount of oil that flows into the second relief outflow portion 52 is gradually reduced, and the amount of the oil relief becomes small [see FIG. 11(B)].

Figure 11A:
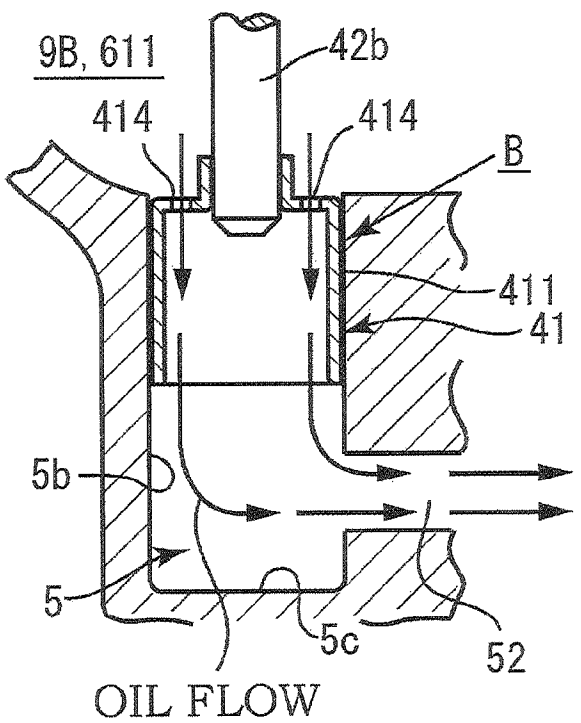
FIG. 11(A) is an enlarged cross-sectional view of a principal portion in a state in which a large amount of oil is relieved by the temperature-sensitive relief valve.
Figure 11B:
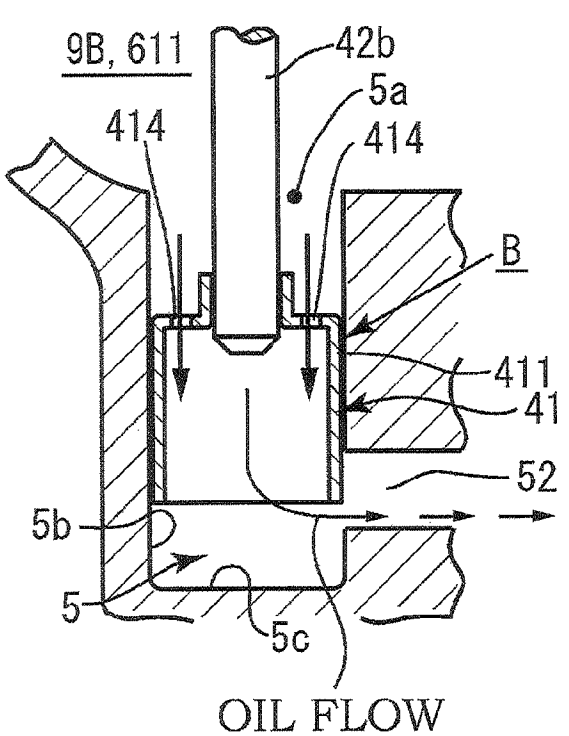
FIG. 11(B) is an enlarged cross-sectional view of the principal portion in a state in which a small amount of oil is relieved by the temperature-sensitive valve.
Figure 11C:
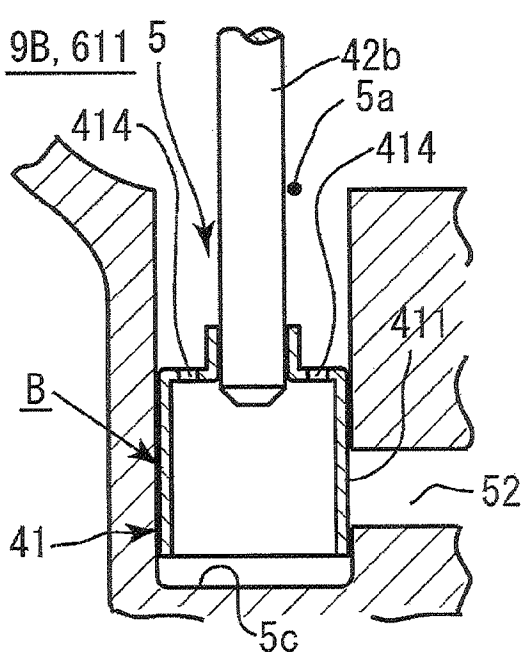
FIG. 11(C) is an enlarged cross-sectional view of the principal portion in a state in which the oil relief is not performed by the temperature-sensitive relief valve.

When the oil temperature further rises to reach the high oil temperature, the temperature-sensitive valve portion 41 slides downward to completely close the second relief outflow portion 52 (fully closed), and the oil relief from the second relief outflow portion 52 is stopped [see FIG. 11(C)]. When the oil pressure is high, the oil pressure relief valve A opens the first relief outflow portion 34 to perform the oil relief (see FIG. 12).

Figures 14A, 14B:
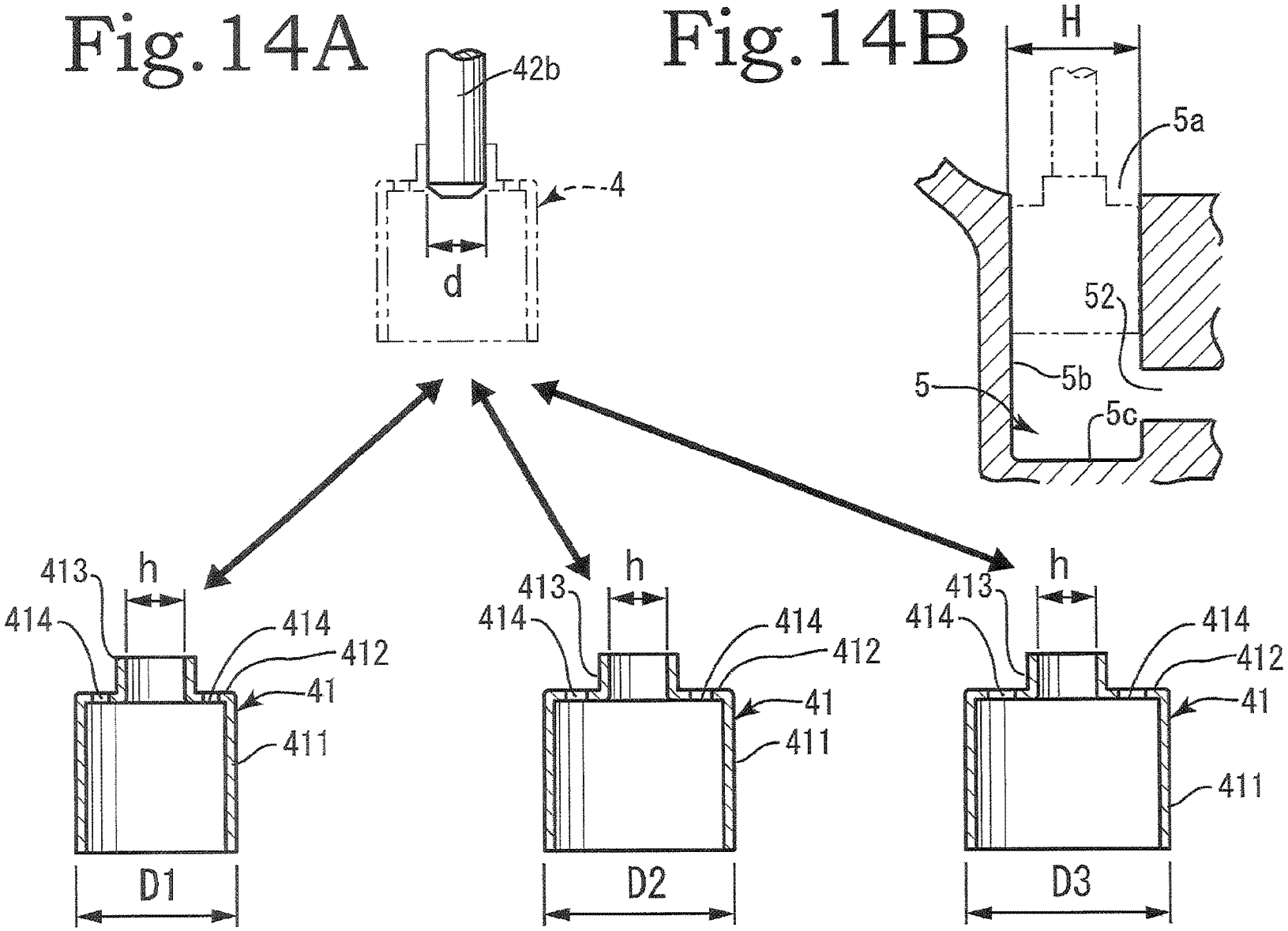
FIG. 14(A) is a cross-sectional view showing that the temperature-sensitive valve portion is selected from a plurality of the temperature-sensitive valve portions having different outer diameters for a piston of the temperature-sensitive valve portion, and can be connected to the piston.
FIG. 14(B) is a cross-sectional view of the location of a temperature-sensitive housing in a pump housing.

The temperature-sensitive relief valve B has an embodiment in which a plurality of the temperature-sensitive valve portions 41, 41 . . . having different outer diameters are provided for one temperature-sensitive drive portion 42 [see FIG. 14(A)]. This embodiment can cope with the situation in which the inner diameter of the temperature-sensitive housing 5 in which the temperature-sensitive valve portion 41 slides variously changes due to the capability of the oil pump 9 such as the discharge amount [see FIG. 14(B)].

First, a plurality of the temperature-sensitive valve portions 41 having different outer diameters D1, D2, D3, Dn, . . . (n is a positive integer indicative of the number) are provided [see FIG. 14(A)]. Inner diameters h of the connection portions 413 of the temperature-sensitive valve portions 41 having different outer diameters are the same. The inner diameter h of the connection portion 413 is set so as to match a shaft diameter (diameter) d of the piston 42*b* of the temperature-sensitive drive portion 42 such that connection with connection means by press-fitting or swaging is allowed.

When the temperature-sensitive relief valve B in the oil pump 9 is mounted, the temperature-sensitive valve portion 41 having the appropriate outer diameter is selected from the plurality of the temperature-sensitive valve portions 41, 41 . . . so as to match the size of the inner diameter H of the temperature-sensitive housing 5, and the selected temperature-sensitive valve portion 41 is connected to the piston 42*b* of the temperature-sensitive drive portion 42 and is used. With this, it is necessary to have only one type of the temperature-sensitive drive portion 42 for the temperature-sensitive housings 5 having many different inner diameters, and it is possible to reduce the cost of the temperature-sensitive relief valve B.

In the case where the relief amount when the oil temperature is low is changed, it is only necessary to change the opening area of the inflow hole 414 of the temperature-sensitive valve portion 41, and the effect is achieved that only one type of the temperature-sensitive drive portion 42 is necessary. Thus, in the temperature-sensitive relief valve B, the same temperature sensor 42*c*, the same cylinder 42*a*, and the same piston 42*b* are used for each model, and the oil pressure characteristic of each model is obtained only by changing the area of the inflow hole 414 of the temperature-sensitive valve portion 41 fixed to the piston 42*b* so that the temperature-sensitive relief valve B can be used widely for many models. That is, it is possible to use the same temperature sensor 42*c*, the same cylinder 42*a*, and the same piston 42*b*, and hence it is possible to reduce the cost with economies of mass production.

Next, there is an embodiment in which a protruding portion 612 that concentrates the flow of oil at the temperature-sensitive drive portion 42 of the temperature-sensitive relief valve B is formed so as to bulge at a position in the discharge portion 9B in the vicinity of the upstream side of the temperature-sensitive relief valve B. Specifically, in the in-housing upstream flow path 611 that constitutes the discharge portion 9B, the protruding portion 612 plays a role in directing the direction of the flow of oil to the location of the temperature sensor 42*c* of the temperature-sensitive drive portion 42. The protruding portion 612 is formed at a position extremely close to the upstream side of the temperature-sensitive relief valve B.

The protruding portion 612 is formed such that the cross section thereof perpendicular to the up-and-down direction of the in-housing upstream flow path 611 has a substantially right triangular mountain-like shape. Atop surface portion 612*a* of the protruding portion 612 in the mountain-like shape is formed into an arc shape. In addition, on the upstream side of the protruding portion 612, an inclined surface 612*b* is formed.

Figure 15A:
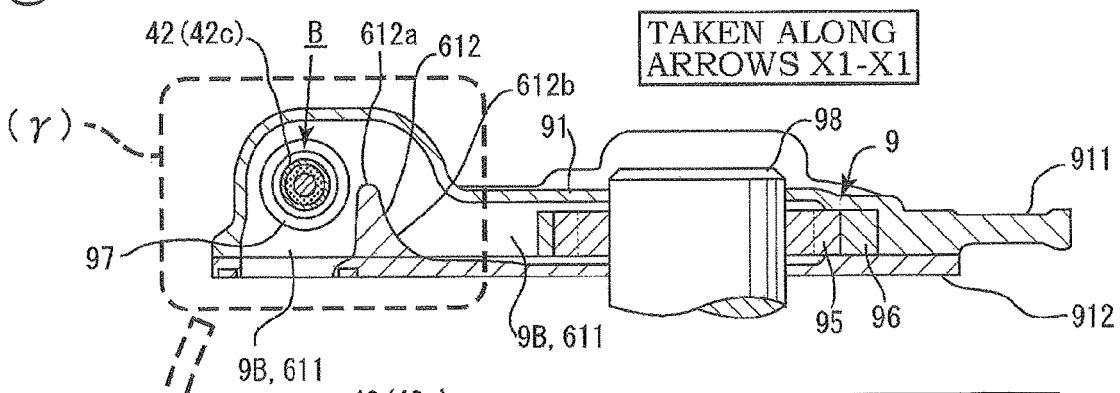
FIG. 15(A) is a cross-sectional view taken along arrows X1-X1 of FIG. 10(A)
Figure 15B:
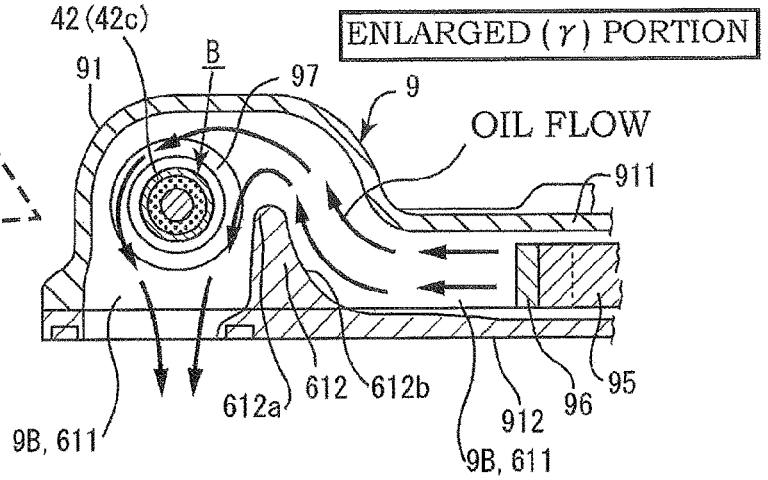
FIG. 15(B) is an enlarged view of a (γ) portion of FIG. 15(A)
Figure 15C:
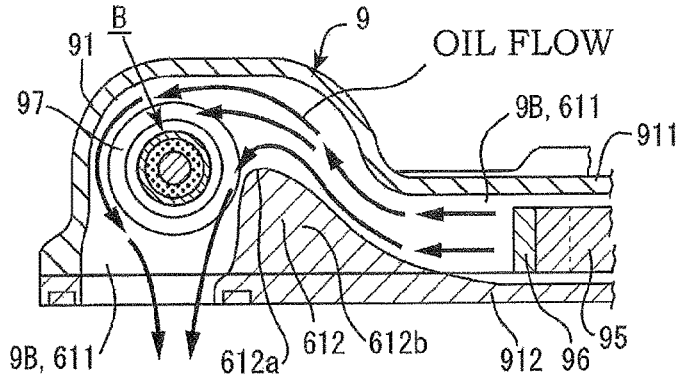
FIG. 15(C) is an enlarged view of a configuration in which a protruding portion of another embodiment is provided in the (γ) portion of FIG. 15(A).

The inclined surface 612*b* is formed into an arc shape, and is depressed inwardly [see FIGS. 15(A) and 15(B)] or expanded outwardly [see FIG. 15(*c*)]. Further, the inclined surface 612*b* is formed into a steeply inclined surface [see FIGS. 15(A) and 15(B)] or a gently inclined surface [see FIG. 15(C)].

Figure 16:
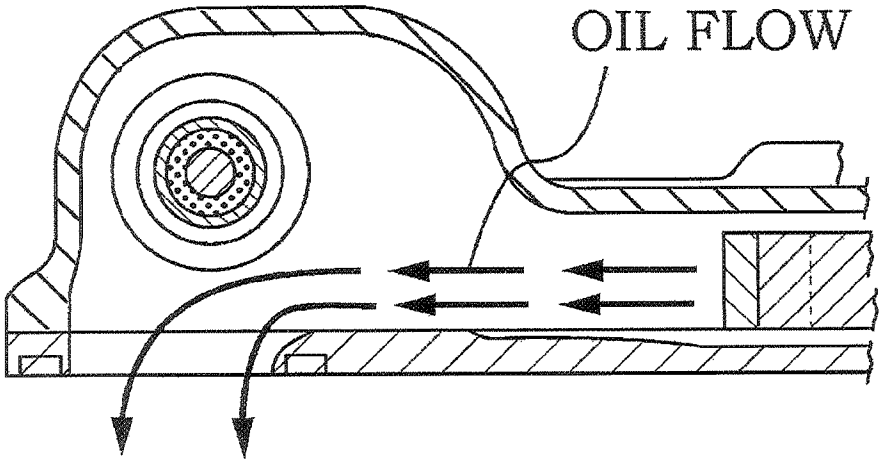
FIG. 16 is an enlarged view of a principal portion of the pump showing the flow of oil of a discharge portion in the case where the protruding portion is not formed.

The position of the top portion 612*a* of the protruding portion 612 is preferably a position closest to the temperature sensor 42*c* of the temperature-sensitive drive portion 42. The direction of the flow is directed to the temperature sensor 42*c* by the protruding portion 612, whereby it is possible to concentrate the flow of oil at the temperature sensor 42*c* as compared with the case where the protruding portion 612 is not present (see FIG. 16) [see FIGS. 15(B) and 15(C)].

The pump housing 91 is constituted by a housing main body portion 911 and a cover portion 912. Normally, principal portions constituting the pump such as the rotor chamber 92, the intake port 93, and the discharge port 94 are provided on the side of the housing main body portion 911, the cover portion 912 is mounted to the housing main body portion 911, and the oil pump 9 is thereby constituted. There are cases where one of the housing main body portion 911 and the cover portion 912 is formed integrally with a casing of the engine or the like.

There are cases where the in-housing upstream flow path 611 is formed by amounting the cover portion 912 to the pump housing 91 and, in these cases, the protruding portion 612 is formed in the cover portion 912 (see FIG. 15). There are cases where the protruding portion 612 is provided separately from the cover portion 912 and is fixed to the cover portion 912 or the protruding portion 612 is formed integrally with the cover portion 912.

The temperature-sensitive drive portion 42 and the temperature-sensitive valve portion 41 of the temperature-sensitive relief valve B require mounting space for mounting them in the pump housing 91. Normally, the space is often provided in a part where the flow path such as the in-housing upstream flow path 611 of the discharge portion 9B is bent, and the space is provided not at a position in the center of a cross section orthogonal to the longitudinal direction of the flow path but at a position close to the side of the end portion thereof. Accordingly, it becomes difficult to concentrate the flow of oil at the temperature sensor 42*c* of the temperature-sensitive drive portion 42, and the speed of detection of the change in the oil temperature tends to be reduced (see FIG. 16).

Thus, by forming the protruding portion 612 at the position in the discharge portion 9B in the vicinity of the upstream side of the temperature-sensitive relief valve B to thereby concentrate the flow of oil especially at the location of the temperature sensor 42*c* of the temperature-sensitive drive portion 42, the temperature sensor 42*c* of the temperature-sensitive drive portion 42 can detect the change in the oil temperature quickly, and it is possible to speed up the response of the temperature-sensitive relief valve B to the oil temperature. In addition, by using the gently inclined surface as the inclined surface 612*b* of the protruding portion 612, it is possible to achieve the structure in which turbulence is less likely to occur in oil that flows in the in-housing upstream flow path 611, and it is possible to reduce noises. Although not particularly shown in the drawing, the temperature-sensitive relief valve B may has a configuration in which the shaft end portion of the piston 42*b* of the temperature-sensitive drive portion 42 is in contact with the holder 44, the temperature sensor 42*c* is disposed below the piston 42*b*, and the temperature-sensitive valve portion 41 is disposed below the temperature sensor 42*c*. This configuration is similar to, e.g., the configuration of a thermo valve shown in FIG. 3 in Japanese Patent Application Laid-open No. 2014-145468. In this case as well, the temperature-sensitive valve portion 41 and the temperature sensor 42*c* vertically move together with the extension/retraction of the piston 42*b*, the present invention holds in this configuration as well, and this configuration is within the scope of the technical idea of the present invention.

REFERENCE SIGNS LIST

A A Oil pressure relief valve
1 Valve body
B Temperature-sensitive relief valve
4 Temperature-sensitive valve body
41 Temperature-sensitive valve portion
414 Inflow hole
42*b* Piston
42 Temperature-sensitive drive portion
5 Temperature-sensitive housing
52 Second relief outflow portion
6 Oil circulation circuit
61 Upstream flow path
612 Protruding portion
62 Downstream flow path
9 Oil pump
7 Relief flow path
71 First relief branch flow path
72 Second relief branch flow path
9A Intake portion
9B Discharge portion
E Engine

The invention claimed is:

1. A relief device of an oil circuit of an engine, the relief device comprising:
- an oil pump;
- an upstream flow path that is provided from a side of a discharge portion of the oil pump to the engine;
- an oil pressure relief valve that performs an oil relief with a movement of a valve body by a pressure of oil; and
- a temperature-sensitive relief valve that performs the oil relief by sensing an oil temperature of the oil, and opening and closing steplessly,
- wherein the oil pressure relief valve and the temperature-sensitive relief valve are disposed in parallel in the upstream flow path,
- wherein a temperature-sensitive drive portion, including a thermowax, and an auxiliaiy elastic Member are respectively attached on opposite sides of the temperature-sensitive relief valve in an axial direction thereof, and
- wherein, in a traversal direction with respect to an arrangement of the thermowax and the auxiliary elastic member in the axial direction, the oil flows to enter the temperature-sensitive relief valve.

2. The relief device of an oil circuit of an engine according to claim 1, wherein the temperature-sensitive relief valve performs the oil relief when the oil has a low oil temperature.

3. The relief device of an oil circuit of an engine according to claim 1, wherein the temperature-sensitive relief valve performs the oil relief such that an amount of the oil relief is increased in a vicinity of a low oil temperature and is reduced in a vicinity of a high oil temperature when the oil has a middle oil temperature.

4. The relief device of an oil circuit of an engine according to claim 1, wherein the temperature-sensitive relief valve does not perform the oil relief when the oil has a high oil temperature.

5. The relief device of an oil circuit of an engine according to claim 1, wherein the temperature-sensitive relief valve is provided in the engine.

6. The relief device of an oil circuit of an engine according to claim 1, wherein the temperature-sensitive relief valve includes a temperature-sensitive valve body and a temperature-sensitive housing,
- wherein the temperature-sensitive valve body includes the temperature-sensitive drive portion and a temperature-sensitive valve portion,
- wherein the temperature-sensitive valve portion includes an inflow hole,
- wherein the temperature-sensitive drive portion includes a piston that extends and retracts in a response to an oil temperature detected with the thermowax, wherein a second relief outflow portion is formed in an inner peripheral side surface of the temperature-sensitive housing, and wherein the temperature-sensitive valve portion is capable of opening and closing the second relief outflow portion by sliding.

7. The relief device of an oil circuit of an engine according to claim 6, wherein the inflow hole of the temperature-sensitive valve portion is configured so as not to intersect an outer periphery of a top portion of the temperature-sensitive valve portion, and wherein the inflow hole is configured so as to be smaller in an opening area than the second relief outflow portion.

8. The relief device of an oil circuit of an engine according to claim 1, wherein a protruding portion that concentrates a flow of the oil at the temperature-sensitive drive portion of the temperature-sensitive relief valve is formed so as to bulge at a position in the discharge portion in a vicinity of an upstream side of the temperature-sensitive relief valve.

9. The relief device of an oil circuit of an engine according to claim 8, wherein the protruding portion is formed into an inclined shape on an upstream side.

10. The relief device of an oil circuit of an engine according to claim 1, wherein the oil pressure relief valve operates independently from the temperature-sensitive relief valve.

11. The relief device of an oil circuit of an engine according to claim 1, wherein the oil pressure relief valve and the temperature-sensitive relief valve are configured to perform the oil relief individually.

12. The relief device of an oil circuit of an engine according to claim 1, wherein the oil pressure relief valve and the temperature-sensitive relief valve are configured to perform the oil relief simultaneously.

13. The relief device of an oil circuit of an engine according to claim 1, wherein, in a response to a change in only one of an oil discharge pressure from the oil pump and the oil temperature of the oil changes, one of the oil pressure relief valve and the temperature-sensitive relief valve is capable of performing the oil relief.

14. The relief device of an oil circuit of an engine according to claim 1, wherein the oil pressure relief valve and the temperature-sensitive relief valve, independent of each other, branch off from the upstream flow path to be connected in parallel.

15. The relief device of an oil circuit of an engine according to claim 1, wherein the oil that flows out of the temperature-sensitive relief valve returns to the oil pump independent of the oil pressure relief valve.

16. The relief device of an oil circuit of an engine according to claim 1, wherein, between the oil pump and the engine, a first relief flow path branches off from the upstream flow path toward the oil pressure relief valve, and a second relief flow path branches off from the upstream flow path toward the temperature-sensitive relief valve.

17. The relief device of an oil circuit of an engine according to claim 1, wherein, between the oil pump and the engine, a first relief flow path branches off from the upstream flow path toward the oil pressure relief valve, and a second relief flow path, independent of the first relief flow path, branches off from the upstream flow path toward the temperature-sensitive relief valve.

18. The relief device of an oil circuit of an engine according to claim 1, wherein the temperature-sensitive relief valve comprises a temperature sensor that includes the thermowax.

19. A relief device, comprising:

an oil pump;

an upstream flow path that extends between a discharge portion of the oil pump and an engine;

an oil pressure relief valve that performs an oil relief with a movement of a valve body by a pressure of oil; and a temperature-sensitive relief valve that performs the oil relief by sensing a temperature of the oil, wherein the oil pressure relief valve and the temperature-sensitive relief valve branch off, in parallel and independent of each other, from the upstream flow path, wherein a temperature-sensitive drive portion, including a thermowax, and an auxiliary elastic member are respectively attached on opposite sides of the temperature-sensitive relief valve in an axial direction thereof, and wherein, in a traversal direction with respect to an arrangement of the thermowax and the auxiliary elastic member in the axial direction, the oil flows to enter the temperature-sensitive relief valve.

20. A relief device of an oil circuit of an engine, the relief device comprising:

an oil pump;

an upstream flow path that is provided from a side of a discharge portion of the oil pump to the engine;

an oil pressure relief valve that performs oil relief with movement of a valve body by pressure of oil; and a temperature-sensitive relief valve that performs the oil relief by sensing an oil temperature of the oil and opening and closing steplessly, wherein the oil pressure relief valve and the temperature-sensitive relief valve are disposed in parallel in the upstream flow path, wherein the temperature-sensitive relief valve includes a temperature-sensitive valve body and a temperature-sensitive housing, wherein the temperature-sensitive valve body includes a temperature-sensitive drive portion and a temperature-sensitive valve portion, wherein the temperature-sensitive valve portion includes an inflow hole, wherein the temperature-sensitive drive portion includes a piston that extends and retracts in response to an oil temperature detected with a thermowax, wherein the temperature-sensitive valve portion is connected to the piston, wherein a second relief outflow portion is formed in an inner peripheral side surface of the temperature-sensitive housing, wherein the temperature-sensitive valve portion is capable of opening and closing the second relief outflow portion by sliding, wherein the temperature-sensitive valve portion comprises a cylindrical portion and a top portion, and includes the inflow hole that is formed through the top portion in an axial direction thereof, and wherein, in a traversal direction with respect to an arrangement of the thermowax and an auxiliary elastic member attached on opposite sides of the temperature-sensitive relief valve in the axial direction, the oil flows to enter the temperature-sensitive relief valve.

21. The relief device of an oil circuit of an engine according to claim 20, wherein the temperature-sensitive relief valve is configured such that a difference in the oil temperature from a start of an operation for performing oil relief to an end thereof is in a range from 70° C. to 100° C.

* * * * *